US009107503B2

(12) United States Patent
Kline

(10) Patent No.: US 9,107,503 B2
(45) Date of Patent: Aug. 18, 2015

(54) SEGMENTED ADAPTABLE MOBILITY AID DEVICE FOR LEVEL AND INCLINED WALKAWAYS AND FOR STAIRS

(71) Applicant: Kevin Roger Kline, Paxinos, PA (US)

(72) Inventor: Kevin Roger Kline, Paxinos, PA (US)

( * ) Notice: Subject to any disclaimer, the term of this patent is extended or adjusted under 35 U.S.C. 154(b) by 0 days.

(21) Appl. No.: 13/665,387

(22) Filed: Oct. 31, 2012

(65) Prior Publication Data

US 2014/0137912 A1 May 22, 2014

(51) Int. Cl.

| | |
|---|---|
| ***A61H 3/00*** | (2006.01) |
| ***A47C 7/00*** | (2006.01) |
| ***A61H 3/04*** | (2006.01) |

(52) U.S. Cl.

CPC *A47C 7/008* (2013.01); *A61H 3/00* (2013.01); *A61H 3/04* (2013.01); *A61H 2003/005* (2013.01); *A61H 2201/0161* (2013.01); *A61H 2201/0192* (2013.01); *A61H 2201/1633* (2013.01)

(58) Field of Classification Search

CPC ..... A61H 2003/001
USPC ..... 135/66, 67
See application file for complete search history.

(56) References Cited

U.S. PATENT DOCUMENTS

| | | | |
|---|---|---|---|
| 2,563,436 | A | 8/1951 | Toth |
| 3,249,368 | A | 5/1966 | Ginzburg |
| 3,272,530 | A | 9/1966 | Klassen |
| 3,354,893 | A | 11/1967 | Schmerl |
| 3,387,618 | A | 6/1968 | Swann |
| 3,421,529 | A | 1/1969 | Vestal |
| 3,422,830 | A | 1/1969 | Cherup |
| 3,455,313 | A | 7/1969 | King |
| 3,537,748 | A | 11/1970 | Knapp |
| 3,800,815 | A | 4/1974 | Birk |

(Continued)

FOREIGN PATENT DOCUMENTS

| | | | |
|---|---|---|---|
| GB | 2194731 | A | 3/1988 |
| JP | 05111548 | A2 | 5/1993 |

(Continued)

OTHER PUBLICATIONS http://www.target.com/Healthline-Adult-Walker-Anti-Slip-Tips/dp/B001FOMDO6/qid=1248661504/ref=br_1_14/192-0536052-1777520?ie=UTF8&node=14029651&frombrowse=1&rh=&page=1 Jul. 25, 2009 Healthline PVC Adult Walker With Anti-Slip Tips.

(Continued)

*Primary Examiner* — Noah Chandler Hawk
(74) *Attorney, Agent, or Firm* — Russ Weinzimmer & Associates, P.C.

(57) ABSTRACT

A segmented adaptable mobility aid device is disclosed that has length-adjustable front and rear legs, a handle, and a knee support platform coupled to the legs and the handle, the legs being adjustable within a range of lengths suitable to straddle steps for ascending and descending stairways, as well as to function on the level, or on a ramp. The lengths of the legs can be adjusted in tandem via single-hand operability of an adjustment mechanism. The knee support platform provides support for an impaired lower leg of a user, not requiring the leg to contact the stairs, and also not requiring the leg to be held mid-air in a hopping motion. The handle enables one-handed use of the segmented adaptable mobility aid device. In some embodiments, spring loaded pins or a pull bar to activate the pins, enable the single-hand operability of the adjustment mechanism.

17 Claims, 35 Drawing Sheets

(56) References Cited

U.S. PATENT DOCUMENTS

| | | | | |
|---|---|---|---|---|
| 3,836,160 | A | | 9/1974 | Linsley |
| 3,945,389 | A | | 3/1976 | Smith |
| 3,968,810 | A | | 7/1976 | Thomas |
| 3,993,349 | A | | 11/1976 | Neufeld et al. |
| 3,999,565 | A | | 12/1976 | Delacour |
| 4,046,374 | A | | 9/1977 | Breyley |
| 4,062,372 | A | | 12/1977 | Slusher |
| 4,094,331 | A | | 6/1978 | Rozsa |
| 4,310,166 | A | | 1/1982 | Eicher |
| 4,314,576 | A | | 2/1982 | McGee |
| 4,411,283 | A | | 10/1983 | Lucarelli |
| 4,474,202 | A | | 10/1984 | Blechner |
| 4,550,802 | A | | 11/1985 | Roper |
| D288,996 | S | | 3/1987 | Winzeler |
| 4,722,538 | A | | 2/1988 | Freyman |
| 4,777,973 | A | | 10/1988 | Nakajima |
| 5,161,640 | A | | 11/1992 | Holbrooks et al. |
| 5,411,035 | A | | 5/1995 | Stone |
| 5,603,517 | A | | 2/1997 | Lorman |
| 5,785,070 | A | | 7/1998 | Block et al. |
| 5,800,317 | A | | 9/1998 | Accetta |
| 5,882,067 | A | | 3/1999 | Carbajal et al. |
| 6,053,189 | A | | 4/2000 | Longenecker et al. |
| 6,145,524 | A | * | 11/2000 | Li et al. ..... 135/67 |
| 6,453,921 | B1 | | 9/2002 | Rost |
| 6,595,530 | B2 | | 7/2003 | Wood |
| 6,626,200 | B1 | | 9/2003 | Reedy |
| 6,692,417 | B2 | | 2/2004 | Burrell |
| 6,705,336 | B2 | | 3/2004 | Goligorski |
| 6,820,949 | B1 | | 11/2004 | Caruso |
| 6,848,696 | B2 | | 2/2005 | Miller |
| 6,959,716 | B1 | | 11/2005 | Schrader |
| D528,780 | S | | 9/2006 | Karasin et al. |
| 7,261,113 | B2 | | 8/2007 | Tartaglia |
| 7,287,767 | B1 | | 10/2007 | Gomes et al. |
| 7,311,319 | B1 | | 12/2007 | Ortega |
| 7,363,931 | B2 | | 4/2008 | Weaver |
| 7,476,187 | B2 | | 1/2009 | Corte |
| 7,490,617 | B2 | | 2/2009 | Bell et al. |
| 7,509,966 | B2 | | 3/2009 | Karasin et al. |
| 2005/0279392 | A1 | | 12/2005 | Lapierre |
| 2006/0033297 | A1 | | 2/2006 | Miller |

FOREIGN PATENT DOCUMENTS

| | | | |
|---|---|---|---|
| JP | 09294789 | A2 | 11/1997 |
| SE | 0519276 | C2 | 2/2003 |
| WO | 9934761 | A1 | 7/1999 |
| WO | 2005110328 | A1 | 11/2005 |

OTHER PUBLICATIONS http://www.ez-step.com/ Jul. 25, 2009 EZ-STEP Climbing stairs is now easier!

http://www.activeforever.com/p-1744-iwalkfree-hands-free-crutch.aspx?intcmp=search Jul. 25, 2009 iWALKFree Hands Free Crutch.

http://www.specialtymedicalsupply.com/pvc-walkers/ Stroller Walker Jul. 25, 2009 PVC Medical Equipment Store.

https://01a731e.netsolstores.com/index.asp?PageAction=VIEWPROD&ProdID=567 Jul. 25, 2009 Knee Walker™.

http://www.thirdwheelortho.com/index.htm Jul. 25, 2009 Third Wheel Orthopedics, LLC.

http://www.maxiaids.com/store/prodView.asp?idproduct=1849&idstore=6&idCategory=219&category=Walker_Accessies&product=Seat_For_Walker Jul. 25, 2009 Seat For Walker.

* cited by examiner

SEGMENTED ADAPTABLE MOBILITY AID DEVICE FOR LEVEL AND INCLINED WALKAWAYS AND FOR STAIRS

Application Ser. No. 12/780,870, filed May 15, 2010, and entitled ADAPTABLE MOBILITY AID DEVICE FOR LEVEL AND INCLINED WALKWAYS AND FOR STAIRS, is herein incorporated by reference in its entirety.

TECHNICAL FIELD

This invention relates generally to mobility aid devices, and more particularly to adaptable mobility aid devices.

BACKGROUND

Reduced mobility is a common plight of individuals with lower leg injuries or individuals who are recovering from lower leg surgery, particularly older individuals. Walkers have been used for decades as aids to improve mobility and sometimes as well to promote healing for leg, ankle, and foot injuries or surgeries. Typically, a walker has four legs with end caps and a structure or frame that surrounds a user's front and sides during use. Some walkers include two or more wheels or casters instead of end caps to make movement of the walker easier. These typical walkers are adequate as walking aids, but in many situations, a user must prevent contact with the floor by an injured foot or ankle. In these circumstances, a user can use only the good leg for bearing weight. Thus, in order to use a typical walker, the user is obliged to use a "step-hop-step-hop- . . . " gait with the healthier leg, an unnatural and uncomfortable manner of getting around. Furthermore, hopping can be difficult or impossible for some older or heavier individuals.

Besides a user's need to hop, other problems are encountered when using a conventional walker. As a prime example, due to their design for use on level or flat walkways, walkers are generally of little use on stairs. They are unstable and unwieldy on stairs at best, and often cannot be used at all on stairs, due to the distance separating front and rear legs being wider than a typical stair step depth. Moreover, the problem of hopping is exacerbated when the individual using a walker needs to climb or descend stairs. This can happen frequently, since stairs are often encountered when a user visits a doctor's office, a physical therapist, and even in some cases, around the home.

Various attempts have been made to modify walkers for use on stairs. These modified walkers, or other mobility aid devices that can be used on stairs, generally have been unwieldy and/or unsuitable for use on a flat walkway. For example, some mobility aid devices have sets of legs with feet or skids at the bases of the legs with the feet or skids parallel to the forward direction of motion of the walker. These sets of legs and feet are configured to fit on two or three stair steps at a time. Some other devices require a complicated series of adjustments for the leg lengths to accommodate stair riser heights or user height. For example, each leg may require loosening of a threaded key or screw to enable adjustment of the length of that leg, and retightening of the key or screw to prevent subsequent undesired changes in length. Having to do this at the foot of a stairway, and then again at the top of a stairway, can be arduous for someone required to stand on only one leg during the adjustment process.

Some modified walkers have included a pad for support of a user's knee or lower leg during use of the walker. These walkers are either unsuitable for use on stairs, or are difficult to adjust between use on stairs and use on level walkways.

SUMMARY

A general aspect of the invention is a segmented adaptable mobility aid device. The device includes a plurality of interconnectable segments, each segment having at least one aperture; a pin engageable with the at least one aperture for interconnecting the plurality of interconnectable segments, and for securing the plurality of interconnectable segments against movement relative to each other; and a support platform configured to be coupled to a predetermined segment of the plurality of interconnectable segments, the support platform being for providing knee support or for providing a seat.

In some embodiments, the plurality of interconnectable segments includes a first segment; a second segment configured to engage the first segment; and a third segment configured to engage the second segment. In further embodiments, the device further includes a lever mechanism coupled to the third segment for adjusting the height of the third segment to the height of a stair step or to the incline of a ramp. In yet further embodiments, the lever mechanism comprises a pin and spring arrangement.

In other further embodiments, the first segment is configured to receive the support platform thereon.

In other further embodiments, the first segment includes a handle including a pair of handle arms; and a first pair of legs coupled to respective ones of the pair of handle arms. In still further embodiments, the second segment includes a second pair of legs configured to engage respective ones of the first pair of legs; and a pair of support uprights coupled to the second pair of legs, and configured to engage respective ones of the pair of handle arms. In yet further embodiments, the third segment includes a third pair of legs configured to engage respective ones of the pair of support uprights. In still yet further embodiments, the device further includes a first footer coupled to the second pair of legs for stabilizing the second pair of legs on a surface; and a second footer coupled to the third pair of legs for stabilizing the third pair of legs on the surface.

BRIEF DESCRIPTION OF THE DRAWINGS

The invention will be more fully understood by reference to the detailed description, in conjunction with the accompanying figures, wherein.

DETAILED DESCRIPTION

FIG. 1A through FIG. 1E depict a sequence of steps that illustrate the use of an adaptable mobility aid device in a preferred embodiment on a level walkway.

Figure 1A:
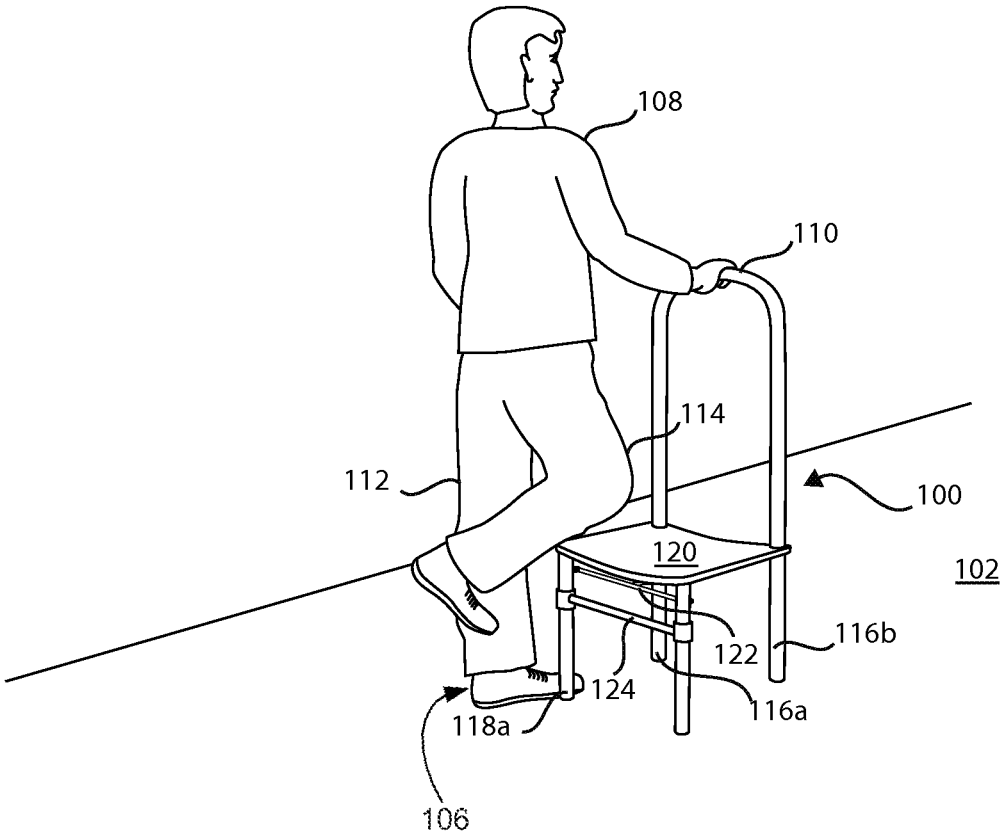
FIG. 1A is an oblique angle view of a preferred embodiment of the present invention in use as an adaptable mobility aid device on a level walkway, showing the device in place in a first position and a knee of a user about to be placed on a knee support platform.

FIG. 1A is an oblique angle view of a preferred embodiment of the present invention in use as an adaptable mobility aid device 100 on a level walkway 102, showing the device in place in a first position 106 and a knee 114 of a user 108 about to be placed on a knee support platform 120. The user 108 of the device 100 is gripping the handle 110 of the device, and is standing erect on a leg 112 with the knee 114 of the other leg bent. The leg 112 is hereinafter referred to as the good leg. The adaptable mobility aid device 100 provides stable support at this point in the sequence so that the user 108 can use the device for knee support during movement of the good leg 112.

Figure 10:
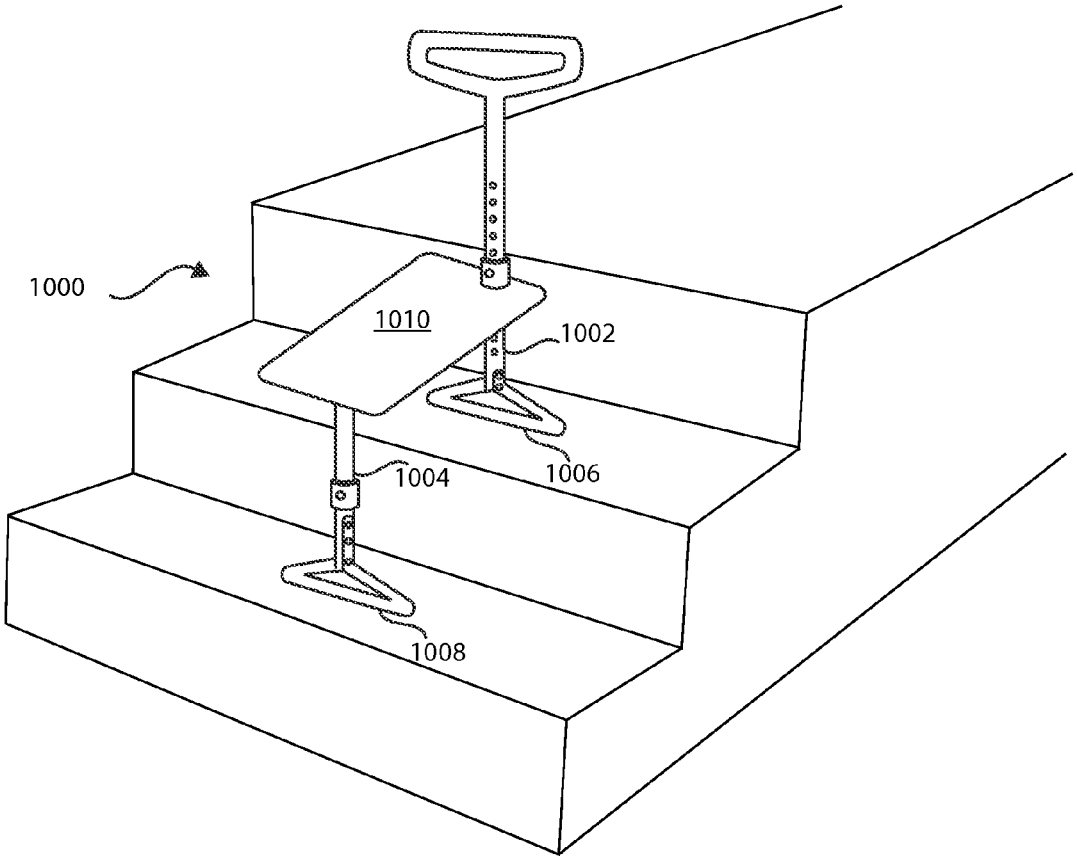
FIG. 10 is an oblique angle view of a preferred embodiment of the present invention, showing an adaptable mobility aid device having a single adjustable front leg and a single adjustable rear leg.

In the embodiment of FIG. 1A, the device 100 includes a pair of front legs 116*a* and 116*b*, a pair of rear legs 118*a* and 118*b*, as well as the knee support platform 120. As shown, the handle 110 is coupled to the knee support platform 120. In the embodiments described herein, the front legs 116*a* and 116*b* and the rear legs 118*a* and 118*b* are coupled to the knee support platform 120. In some preferred embodiments, the front legs 116*a* and 116*b* and the rear legs 118*a* and 118*b* are configured for frictional contact with a walkway and/or stairway. It is understood that embodiments of the present invention can have fewer than two front legs, for example, at least one front leg, and can have fewer than two rear legs, for example, at least one rear leg. FIG. 10, discussed below, shows an embodiment with one front leg and one rear leg. It is also understood that some embodiments can have three legs. In FIG. 1A, the device has a front side with which the at least one front leg is coupled, and the handle 110 forms a portion of the front side. Moreover, the at least one front leg and at least one rear leg are parallel, one with another.

In FIG. 1A, an adjustment mechanism (402, see FIGS. 4 and 4A), also referred to herein as an adjustability mechanism, can be activated by a spring-loaded pull bar 122 to enable length adjustability of the front legs 116*a* and 116*b*. In various preferred embodiments discussed below, the adjustment mechanism includes an adjustable coupling, and is single hand operable through single hand operability of the adjustable coupling. A separate adjustment mechanism 124, likewise also referred to herein as an adjustability mechanism, enables length adjustability of the rear legs 118*a* and 118*b*. By use of the adjustment mechanisms 402 and 124, the device 100 can be adjusted so that the knee support platform 120 is at a comfortable height for use by the user 108.

Figure 1B:
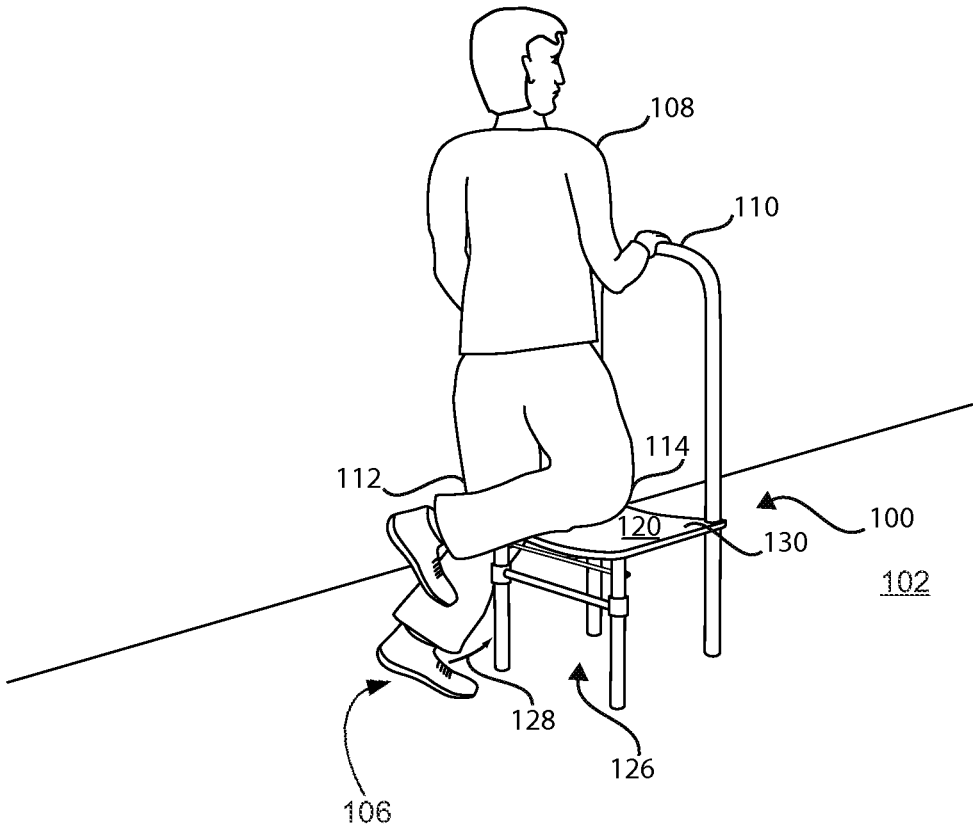
FIG. 1B is an oblique angle view of the preferred embodiment of FIG. 1A, showing the bent knee of one leg supported by the knee support platform while the user takes a step with the good leg, from the first position to a second position.

FIG. 1B is an oblique angle view of the preferred embodiment of FIG. 1A, showing the bent knee 114 of one leg supported by the knee support platform 120 while the user 108 takes a step with the good leg 112, from the first position 106 (see FIG. 1A) to a second position 126. As shown in FIG. 1B, the user 108 continues to grip the handle 110 of the device 100, while the bent knee 114 bears the entire weight of the user.

Because the knee support platform 120 supports the knee 114, which supports the weight of the user 108 at this point in the sequence, the user can move the good leg 112 forward to take a step 128 without having to hop from the first position 106 to the second position 126. Moreover, the knee support platform 120 has a flat padded upper surface 130 to provide more comfortable support for the knee 114. In some preferred embodiments the upper surface 130 is contoured rather than flat.

Figure 1C:
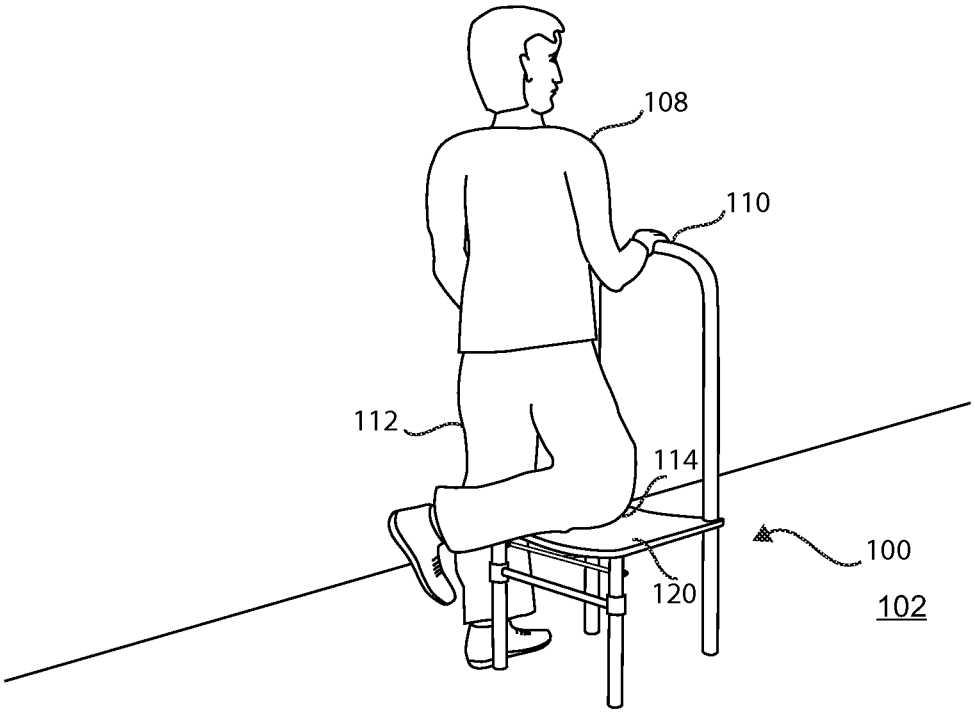
FIG. 1C is an oblique angle view of the preferred embodiment of FIG. 1A, showing the bent knee of one leg supported by the knee support platform, the user having taken the step with the other leg, from the first position to the second position.

FIG. 1C is an oblique angle view of the preferred embodiment of FIG. 1A, showing the bent knee 114 of one leg supported by the knee support platform 120, the user 108 having taken the step 128 (see FIG. 1B) with the other leg 112, from the first position 106 (see FIG. 1A) to the second position 126 (see FIG. 1B). The user 108 continues to grip the handle 110 of the device 100, while both the good leg 112 and the bent knee 114 can bear the weight of the user.

Figure 1D:
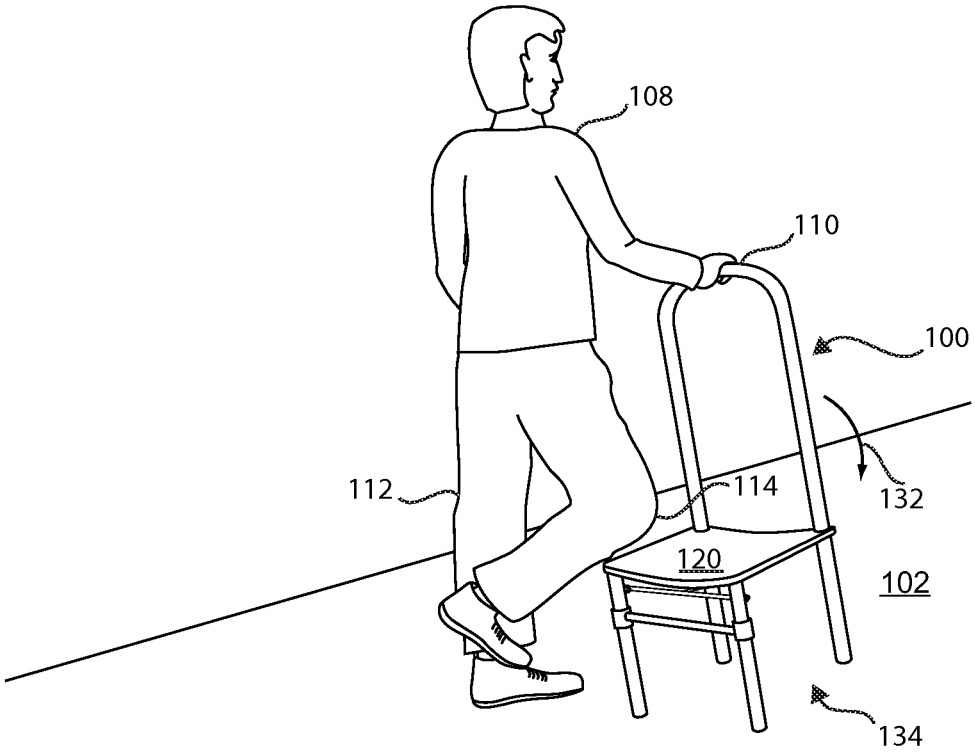
FIG. 1D is an oblique angle view of the preferred embodiment of FIG. 1A, showing the step completed, the user having removed the knee from the knee support platform and/or shifting his weight to the good leg, and moving the device to a third position about a distance of one step ahead of the second position.

FIG. 1D is an oblique angle view of the preferred embodiment of FIG. 1A, showing the step 128 (see FIG. 1B) completed, the user 108 having removed the knee 114 from the knee support platform 120 and/or shifting his weight to the good leg 112, and moving 132 the device 100 to a third position 134 about a distance of one step ahead of the second position 126 (see FIG. 1B). The user 108 of the device 100 has lifted the device with one hand on the handle 110 of the device, and is standing erect on the good leg 112 with the knee 114 of the other leg bent.

Figure 1E:
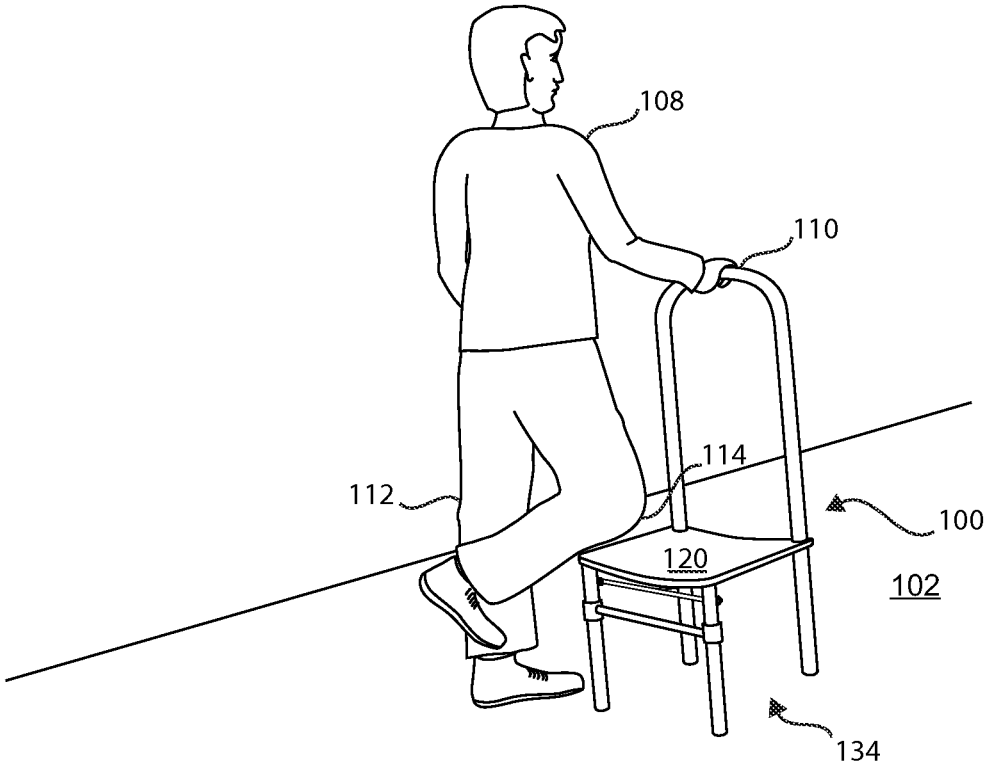
FIG. 1E is an oblique angle view of the preferred embodiment of FIG. 1A, showing the device in place in the third position and the knee of the user about to be placed on the knee support platform.

FIG. 1E is an oblique angle view of the preferred embodiment of FIG. 1A, showing the device 100 in place in the third position 134 and the knee 114 of the user 108 about to be placed on the knee support platform 120. The user 108 having taken a step is thus brought to a similar point in the sequence as is shown above in FIG. 1A. In FIG. 1E, the user 108 of the device 100 is gripping the handle 110 of the device, and continues to stand on the good leg 112 with the knee 114 of the other leg bent. The adaptable mobility aid device 100 provides stable support at this point in the sequence so that the user 108 can use the device for knee support during movement of the good leg 112.

FIG. 2A through FIG. 2E depict a sequence of steps that illustrates the use of an adaptable mobility aid device in a preferred embodiment on a stairway.

Figure 2A:
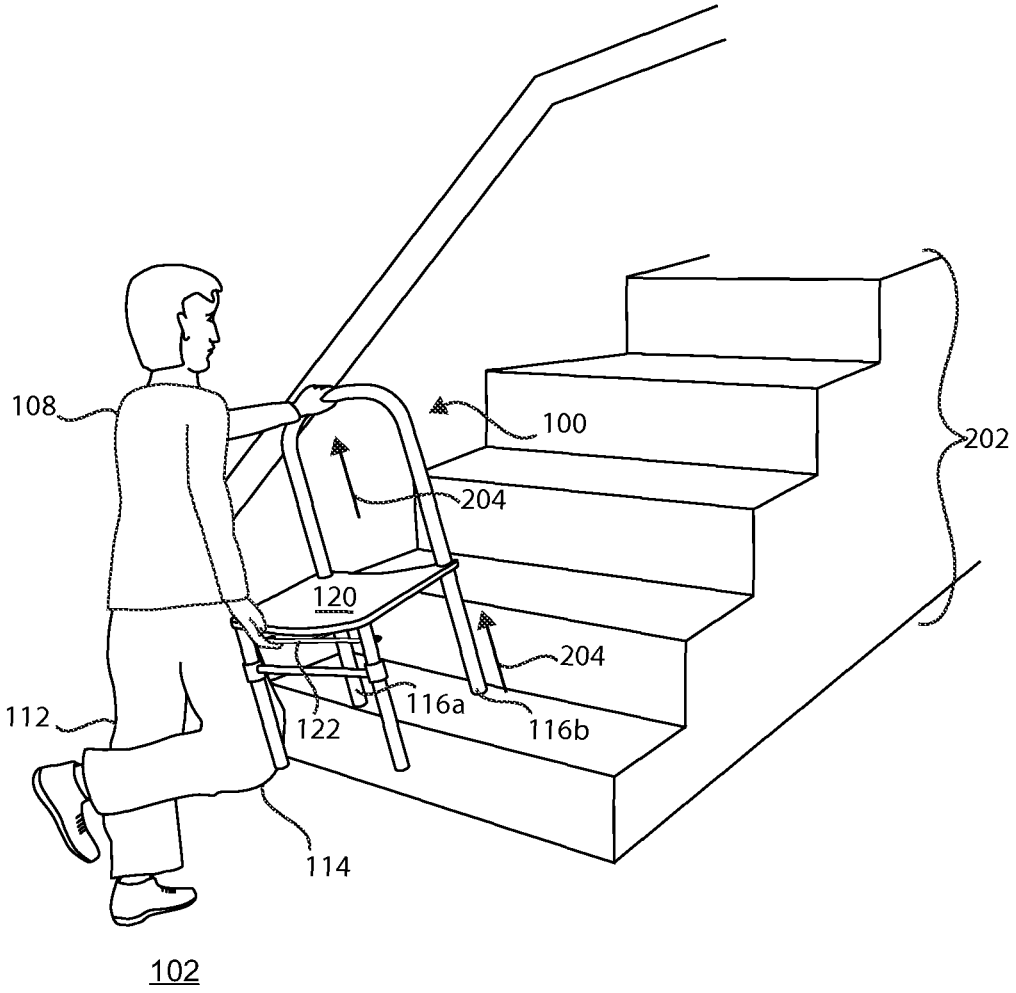
FIG. 2A is an oblique angle view of the preferred embodiment of FIG. 1A, showing the user at the bottom of a stairway, the user having removed the knee from the knee support platform and standing erect on the good leg.

FIG. 2A is an oblique angle view of the preferred embodiment of FIG. 1A, showing the user 108 at the bottom of a stairway 202, the user 108 having removed the knee 114 from the knee support platform 120 and standing erect on the good leg 112. The user 108 is operating an adjustment mechanism (402, see FIG. 4A) via the spring-loaded pull bar 122 to convert the device 100 from use on the level walkway 102 to use on the stairway 202 by shortening the front legs 116*a*, 116*b* as shown by the arrow 204. The adjustment mechanism 402 is single-hand operable via a pull by the user 108 and configured to shorten or lengthen the front legs 116*a*, 116*b* in tandem. By use of the adjustment mechanism 402, the device 100 can be adjusted so that the knee support platform 120 is level and remains at a comfortable height for use by the user 108, when the device is used on stairs.

Figure 2B:
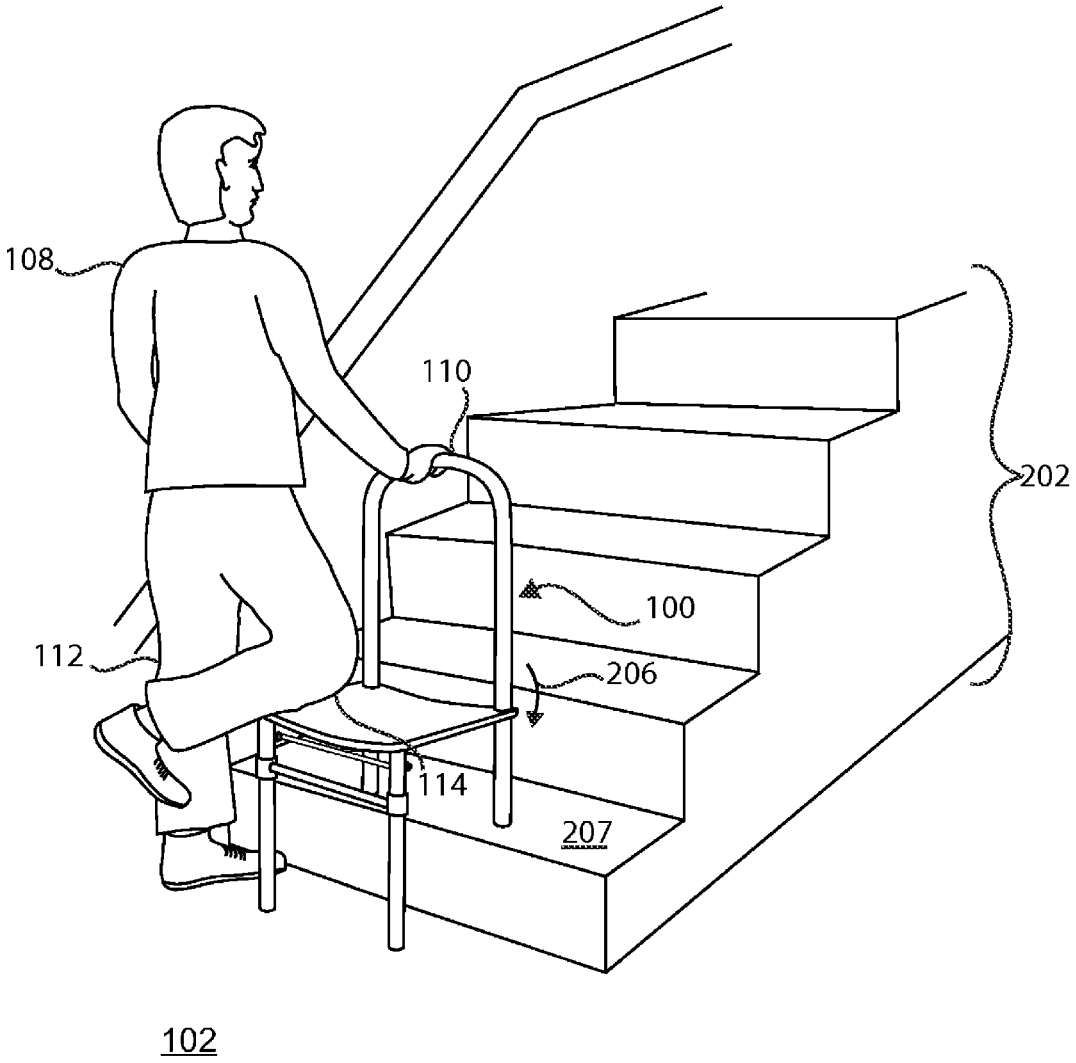
FIG. 2B is an oblique angle view of the preferred embodiment of FIG. 1A, illustrating the device in use as a adaptable mobility aid device on a stairway, and showing placement of the device on the bottom stair of the stairway.

FIG. 2B is an oblique angle view of the preferred embodiment of FIG. 1A, illustrating the device 100 in use as an adaptable mobility aid device on a stairway 202, and showing placement 206 of the device on the bottom stair 207 of the stairway. The user 108 of the device 100 has lifted the device with one hand on the handle 110 of the device, and is standing erect on the good leg 112 with the knee 114 of the other leg bent. For stairway use, the adaptable mobility aid device 100 is configured so that the front legs 116*a* and 116*b* (see FIG. 2A) engage an upper step and the rear legs 118*a* and 118*b* (see FIG. 1A) engage an adjacent lower step so as to support the knee support platform in a position over a portion of the upper step and over a portion of the adjacent lower step, and with the knee support platform disposed approximately horizontally. It will be appreciated that the device 100 is designed to straddle and span two steps for use on stairs, an aspect of the invention that will be discussed further below in connection with FIG. 2E. As used herein and in the accompanying claims, the term step refers to an upper surface of a stair step as well as a portion of a flat walkway adjacent a stairway.

Figure 2C:
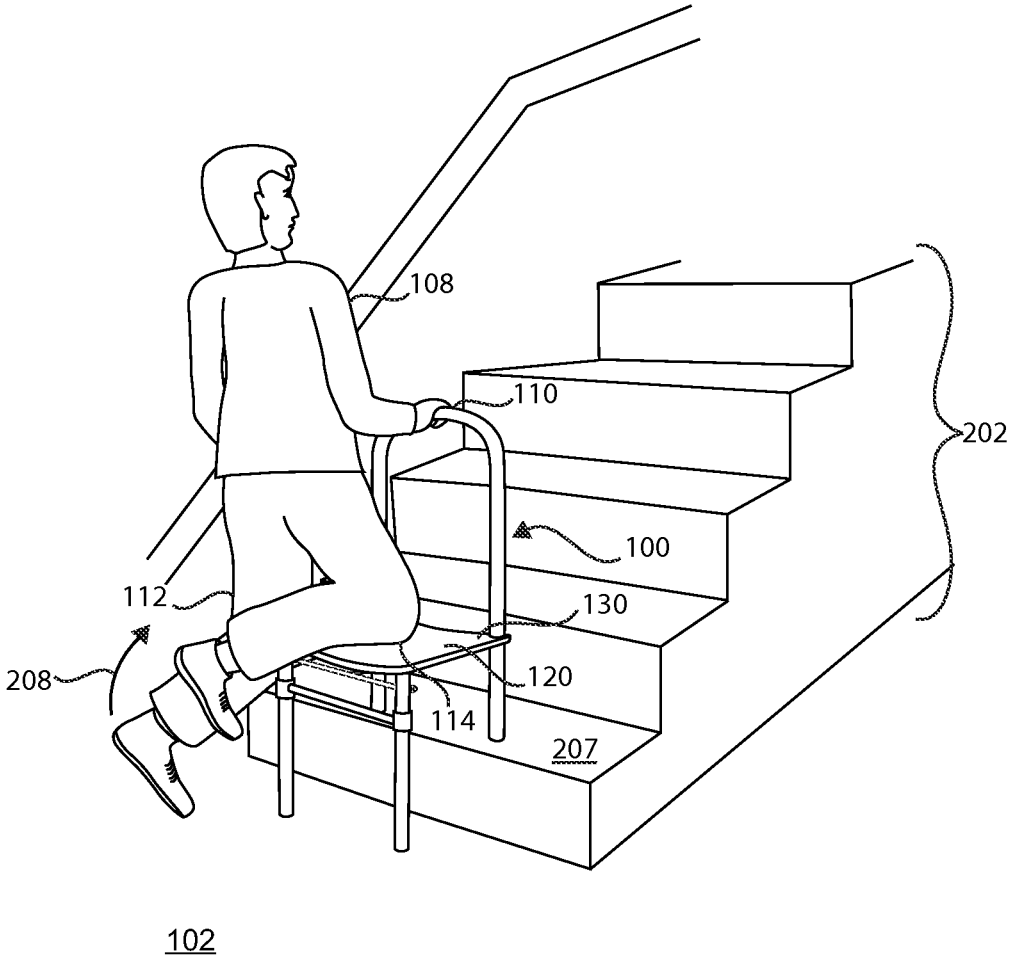
FIG. 2C is an oblique angle view of the preferred embodiment of FIG. 1A, showing the bent knee of one leg supported by the knee support platform while the user takes a step with the good leg, from the bottom of the stair to the adjacent step.

FIG. 2C is an oblique angle view of the preferred embodiment of FIG. 1A, showing the bent knee 114 of one leg supported by the knee support platform 120 while the user 108 takes 208 a step with the good leg 112, from the bottom of the stair to the adjacent step 207. The user 108 continues to grip the handle 110 of the device 100, while the bent knee 114 bears the entire weight of the user.

Because the knee support platform 120 supports the knee 114, which supports the weight of the user 108 at this point in the sequence, the user can move the good leg 112 forward and upward to advance 208 to the stair step 207 without having to hop from the lower step to the next stair step. Moreover, as mentioned previously, the knee support platform 120 has a flat padded upper surface 130 to provide more comfortable support for the knee 114.

Figure 2D:
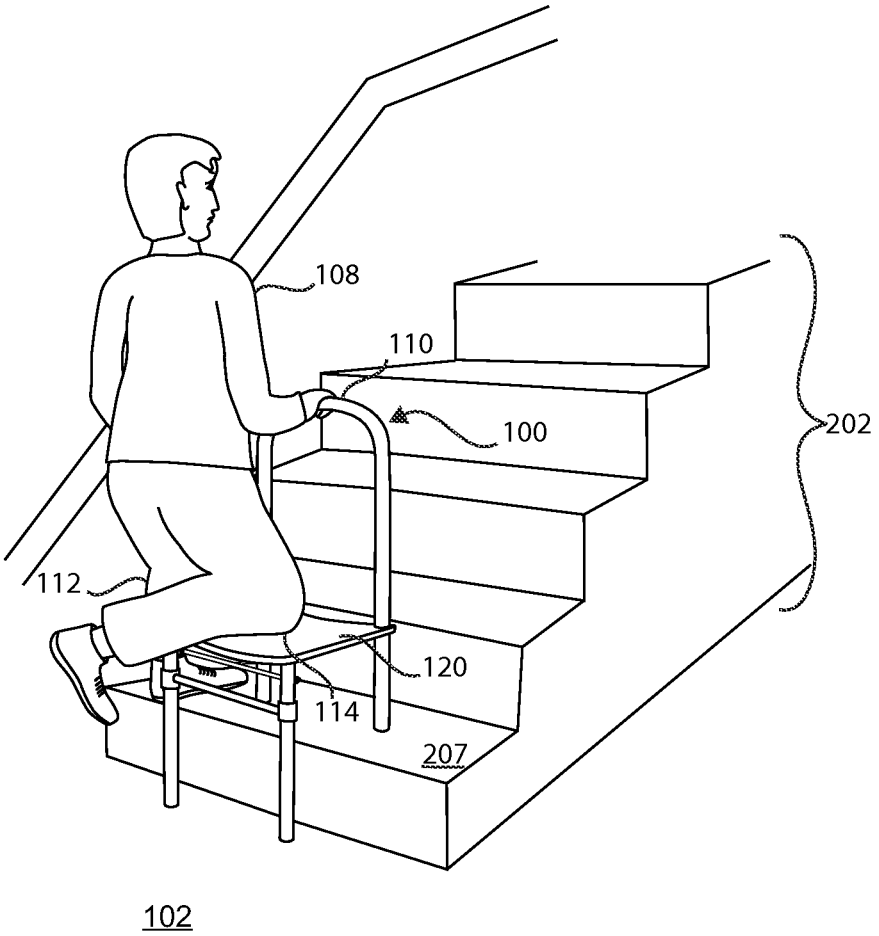
FIG. 2D is an oblique angle view of the preferred embodiment of FIG. 1A, showing the bent knee of one leg supported by the knee support platform, the user having taken the step with the good leg, from the bottom of the stairway to the bottom stair step.

FIG. 2D is an oblique angle view of the preferred embodiment of FIG. 1A, showing the bent knee 114 of one leg supported by the knee support platform 120, the user 108 having taken the step with the good leg 112, from the bottom of the stairway 202 to the bottom stair step 207. The user 108 continues to grip the handle 110 of the device 100, while both the good leg 112 and the bent knee 114 can bear the weight of the user.

Figure 2E:
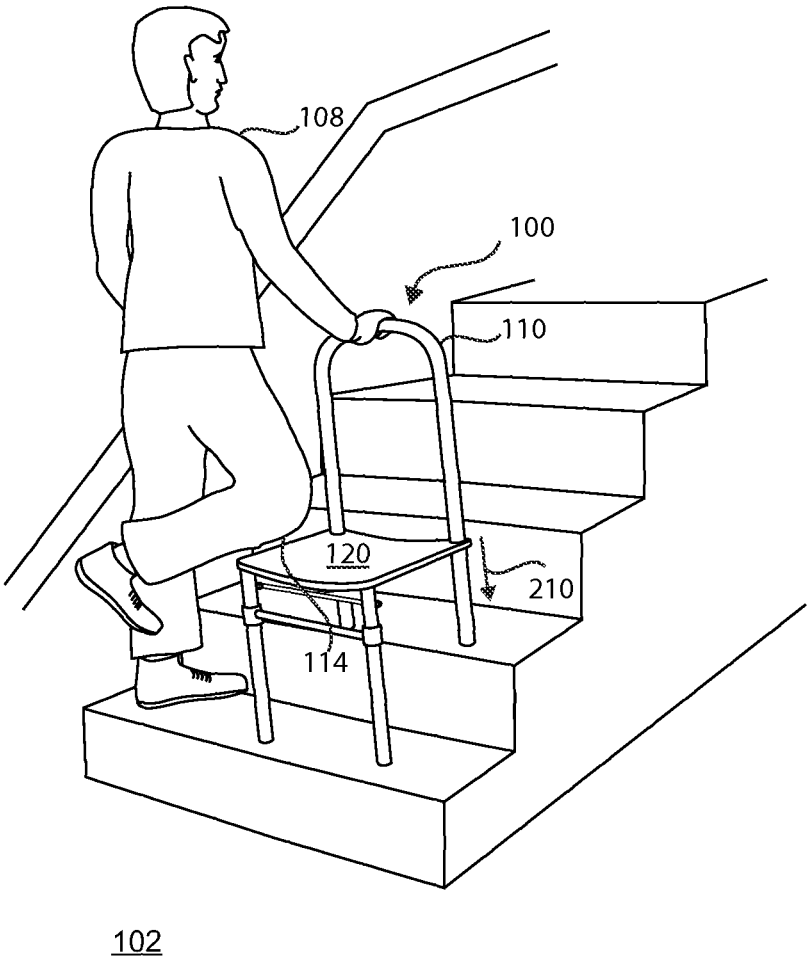
FIG. 2E is an oblique angle view of the preferred embodiment of FIG. 1A, showing the step completed, the user having removed the knee from the knee support platform and moving the device to the next stair step.

FIG. 2E is an oblique angle view of the preferred embodiment of FIG. 1A, showing the step completed, the user 108 having removed the knee 114 from the knee support platform 120 and moving 210 the device 100 to the next stair step. The user 108 of the device 100 has lifted the device with one hand on the handle 110 of the device, and is standing erect on the good leg 112 with the knee 114 of the other leg bent. It is understood that descending a step can be accomplished by a user by backing down the stairs and performing the steps shown in FIGS. 2A-2E in the reverse order.

As mentioned previously, the device 100 is designed to straddle and span two steps when used on a stairway. The capability of the device 100 to straddle two steps enhances the usability of the device on stairs, and can enhance the stability of a user employing the device, for several reasons. First, in various embodiments, the device 100 has a footprint of about 9 inches square or larger, contributing to its greater stability over currently available adaptable mobility aid devices with smaller footprints that generally rest on only a single step when used on stairs.

Second, during use on a stairway, an exemplary knee support platform is positioned so as to span two steps. Thus, while the user is taking a step, or when the user shifts his or her weight from the good leg, the weight of the user is distributed between the two steps. In this situation, a slight shift of the user's posture brings the majority of the user's weight to bear on the upper step, or on the lower step. This capability to shift the user's weight to the upper step or alternatively the lower step can make it easier for the user to mount or descend stairs.

Third, the positioning of the knee support platform over both steps results in the user's center of gravity being positioned about midway between the two steps. This is a much more natural positioning of the user's center of gravity while the user takes a step from one step to an adjacent step, whether ascending or descending. The more natural position can make it easier for the user to mount or descend stairs.

Fourth, use of the device 100 for descending stairs can better accommodate the frequently limited mobility of the user. The stairway descent is safer in that a user descends the stairs by lowering the good leg 112 first, then the device 100 is transported to the lower step with the weight of the user supported by the good leg. In contrast, when descending stairs using an adaptable mobility aid device that doesn't straddle two steps but instead rests on only a single step, typically a user is obliged to lower the device, and the injured leg, first. The knee of the good leg must be bent during this transition from one step to the lower step, while at the same time, the weight of the user must be borne by the good leg. Then, after the device and injured leg are positioned on the next lower step, a step to the lower step is taken with the good leg. The user may be put in an awkward and unstable position during part of this sequence. Furthermore, this mode of descent can be problematic for uncoordinated and/or elderly individuals.

Thus, by its design for straddling stairs, the device 100 fosters use of a more natural gait by the user during ascent and descent of stairs. Moreover, adjustment of the front legs of the device 100 to afford the stability just discussed can be done in seconds without tools, using a single hand to operate the adjustment mechanism.

In many cases, an individual recovering from lower leg surgery or a leg injury can become fatigued by the effort of climbing or descending a staircase. Such individuals may wish to sit for a short time to gain a respite from the effort of climbing or descending. Embodiments of the present invention readily provide such respite from the exertion of stair use. Use of the device 100 as a seat for resting is discussed in connection with FIGS. 3 and 3B.

Figure 3:
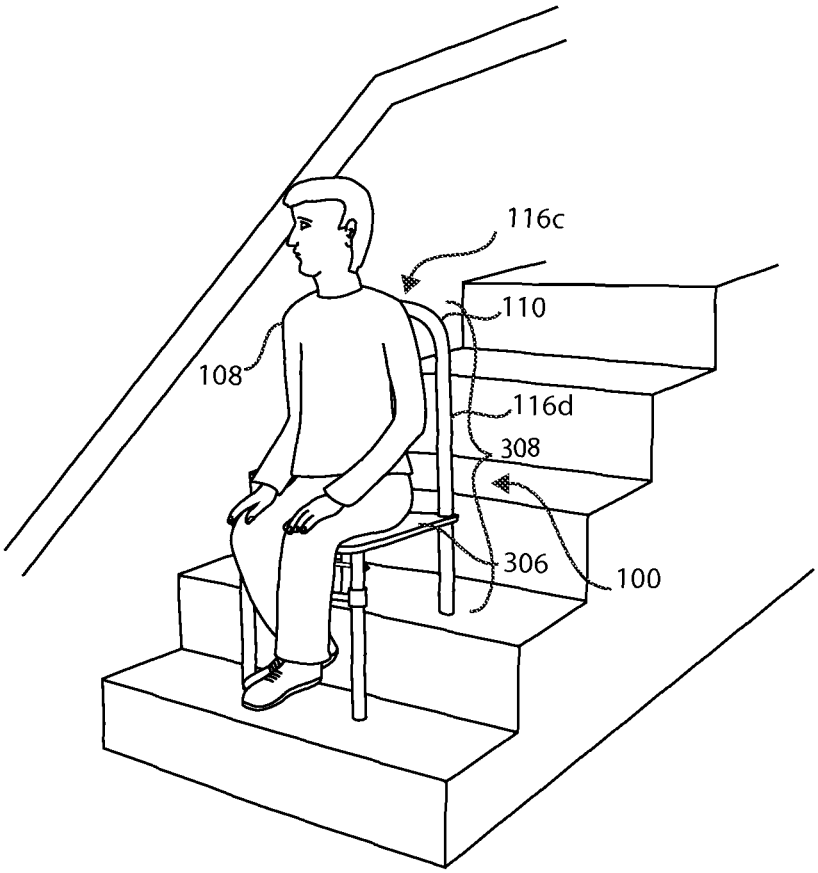
FIG. 3 is an oblique angle view of the preferred embodiment of FIG. 1A, showing use of the knee support platform as a seat for resting during climbing or descending stairs.

FIG. 3 is an oblique angle view of the preferred embodiment of FIG. 1A, showing use of the knee support platform 120 (see FIG. 1A) as a seat 306 for resting during climbing or descending stairs. The handle 110 of the device 100, along with the leg extensions 116*c* and 116*d*, which act as upright supports for the handle, form a back support frame 308 when the knee support platform 120 is in use as a seat 306. In this manner a user 108 of the adaptable mobility aid device 100 can recover to some extent from fatigue due to stair climbing or descending.

Figure 3A:
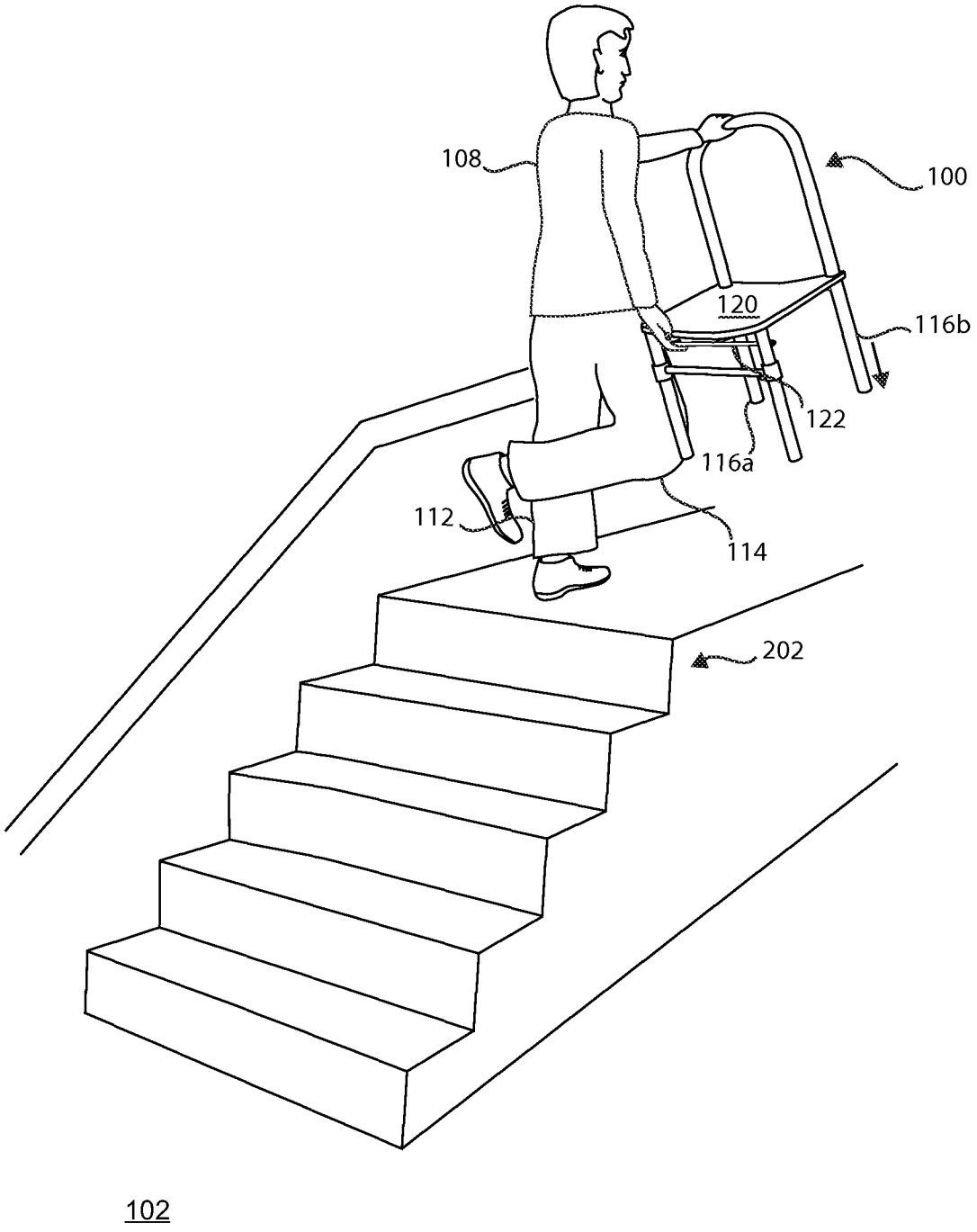
FIG. 3A is an oblique angle view of the preferred embodiment of FIG. 1A, showing the user at the top of the stairway, the user having removed the knee from the knee support platform and standing erect on the good leg.

FIG. 3A is an oblique angle view of the preferred embodiment of FIG. 1A, showing the user 108 at the top of the stairway 202, the user having removed the knee 114 from the knee support platform 120 and standing erect on the good leg 112. The user 108 is operating the adjustment mechanism 402 (see FIG. 4A) to convert the device 100 from use on the stairway to use on a flat walkway by lengthening the front legs 116*a* and 116*b*. As mentioned previously, the adjustment mechanism 402 is single-hand operable, and is configured to lengthen the front legs 116*a* and 116*b* in tandem. As in FIG. 1E, the adjustment mechanism is operable via a pull of the pull bar 122 by the user 108, as shown. By use of the adjustment mechanism 402, the device 100 can be adjusted so that the knee support platform 120 is level and remains at a comfortable height for use by the user 108, when the device is used on a level walkway.

In many cases, an individual recovering from lower leg surgery or a leg injury can become fatigued even by the effort of walking on a level walkway. Such individuals may wish to sit for a short time to gain a respite from the effort of walking. Embodiments of the present invention readily enable respite from the exertion of walking on a level walkway, as discussed next.

Figure 3B:
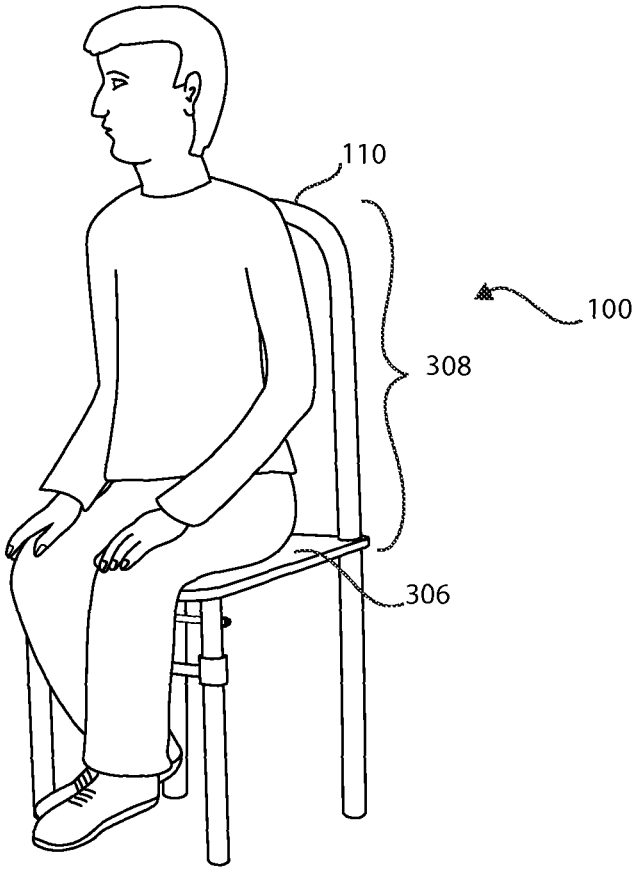
FIG. 3B is an oblique angle view of the preferred embodiment of FIG. 1A, showing use of the knee support platform as a seat for resting during use of the device on a walkway, such as the level walkway.

FIG. 3B is an oblique angle view of the preferred embodiment of FIG. 1A, showing use of the knee support platform 120 (see FIG. 1A) as a seat 306 for resting during use of the device 100 on a walkway, such as the level walkway 102 (see FIG. 1A). The handle 110 of the device 100, along with the leg extensions 116*c* and 116*d* (see FIG. 3) that form upright supports for the handle, form a back support frame 308 when the knee support platform 120 is in use as a seat 306. It will be appreciated that adjustability of the front legs enables use of the device 100 as a seat even on an inclined walkway, should a user become fatigued during use of the device on the inclined walkway.

Figure 4:
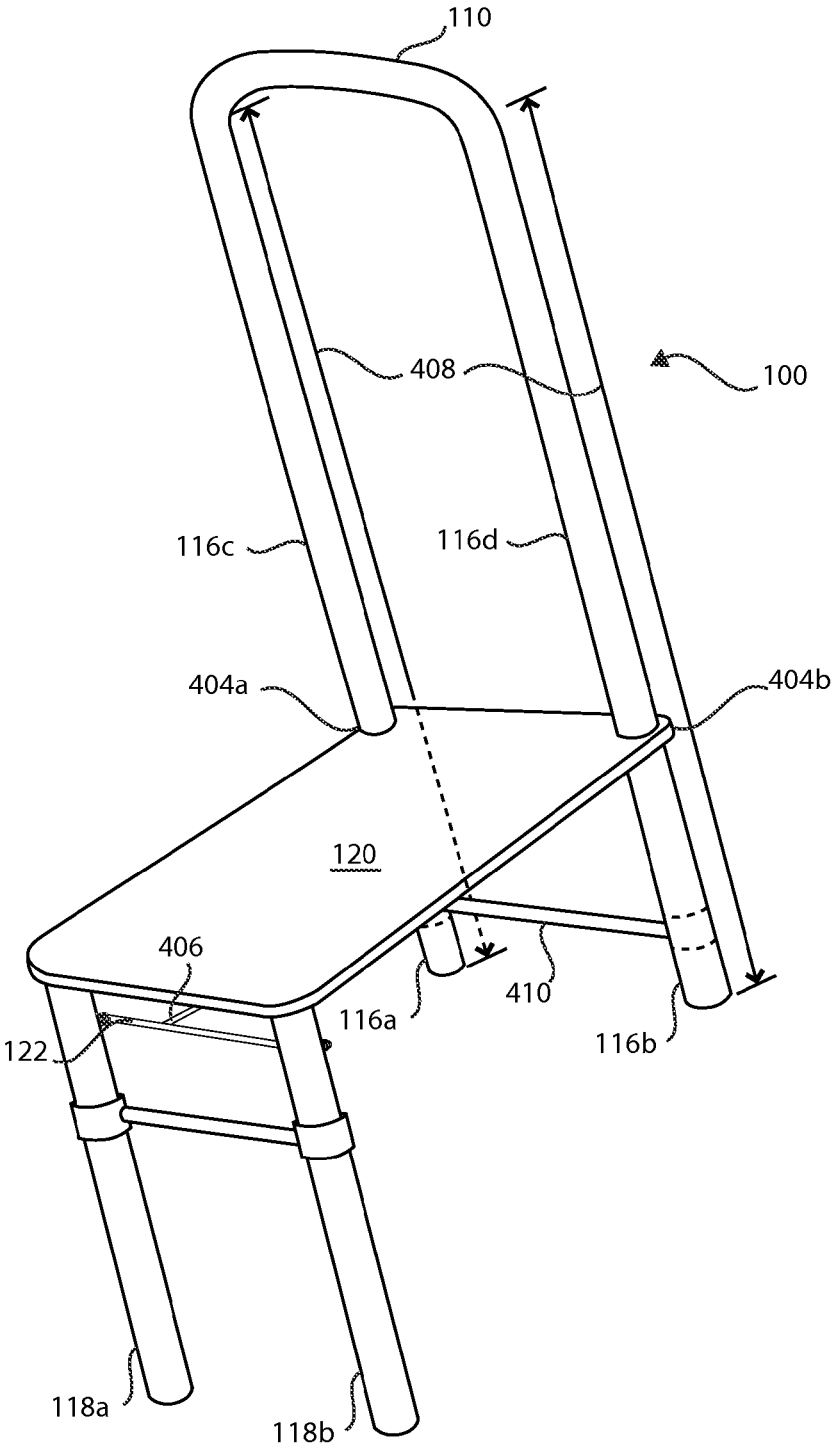
FIG. 4 is an oblique angle view of the embodiment of FIG. 1A, showing the adaptable mobility aid device by itself to better portray the adjustment mechanism by which the length of the front legs can be adjusted.

FIG. 4 is an oblique angle view of the embodiment of FIG. 1A, showing the adaptable mobility aid device 100 by itself to better portray the adjustment mechanism 402 by which the length of the front legs 116*a* and 116*b* can be adjusted. As shown in FIG. 4, the adjustment mechanism 402 includes two sleeves 404*a* and 404*b* coupled to the knee support platform 120. The legs 116*a* and 116*b* are coupled with the handle 110 through leg extensions 116*c* and 116*d*. In the preferred embodiment of FIG. 1A, the legs 116*a* and 116*b*, and the leg extensions 116*c* and 116*d*, have the same diameter, and are configured to nest within the sleeves 404*a* and 404*b*. Ordinarily, the legs and leg extensions 116*a* through 116*d* are locked in position until the adjustment mechanism 402 is activated. It is understood that leg adjustability can be enabled in other ways, for example, each leg may be configured as a rail sliding inside a groove or larger rail, and nesting need not mean only complete surrounding by the sleeve, but alternatively may encompass the interlocking of sliding rails as just described.

The adjustment mechanism 402 is activated when a pull on the pull bar 122 is communicated to the adjustment mechanism 402 by the linkage 406. The spring-loading of the pull bar 122 may be accomplished through the linkage 406 of the pull bar with, for example, spring-loaded pins (see FIG. 4A). When the adjustment mechanism is activated, the legs 116*a* and 116*b* can be lengthened or shortened together by a push down or pull up on the handle 110. That is, the leg 116*a* and the leg extension 116*c* have a fixed combined length 408. Similarly, the leg 116*b* and the leg extension 116*d* have the same fixed combined length 408. Thus, a push down on the handle 110 when the adjustment mechanism 402 is activated increases the length of the legs 116*a* and 116*b* below the knee support platform 120, while decreasing the lengths of the leg extensions 116*c* and 116*d* above the knee support platform. Conversely, a pull up on the handle 110 when the adjustment mechanism 402 is activated decreases the length of the legs 116*a* and 116*b* below the knee support platform 120, while increasing the lengths of the leg extensions 116*c* and 116*d* above the knee support platform.

It will be appreciated that other adjustment mechanisms having adjustable couplings can be adapted for use on an adaptable mobility aid device 100 by skilled artisans without undue experimentation. An adaptable mobility aid device that incorporates any such adjustment mechanism and/or adjustable coupling, and that embodies the inventive concepts described herein of straddling two adjacent steps during stairway use, is within the scope of the present disclosure. Preferred embodiments of the present invention that include alternative adjustment mechanisms and/or adjustable couplings are described in detail below.

In some alternative embodiments, the actuator for the adjustment mechanism may be positioned close to the front legs 116*a* and 116*b*, rather than close to the rear legs 118*a* and 118*b* as shown by the pull bar 122 and linkage 406. These details are discussed further in connection with FIG. 4A. Also, in some of these alternative embodiments, the legs 116*a* and 116*b* have a smaller diameter than the leg extensions 116*c* and 116*d*, and are configured to nest within the leg extensions, as well as nesting within the sleeves 404*a* and 404*b*. A crosspiece or crossbar 410 enables sliding of the legs 116*a* and 116*b* in tandem when the adjustment mechanism 402 is activated.

Figure 4A:
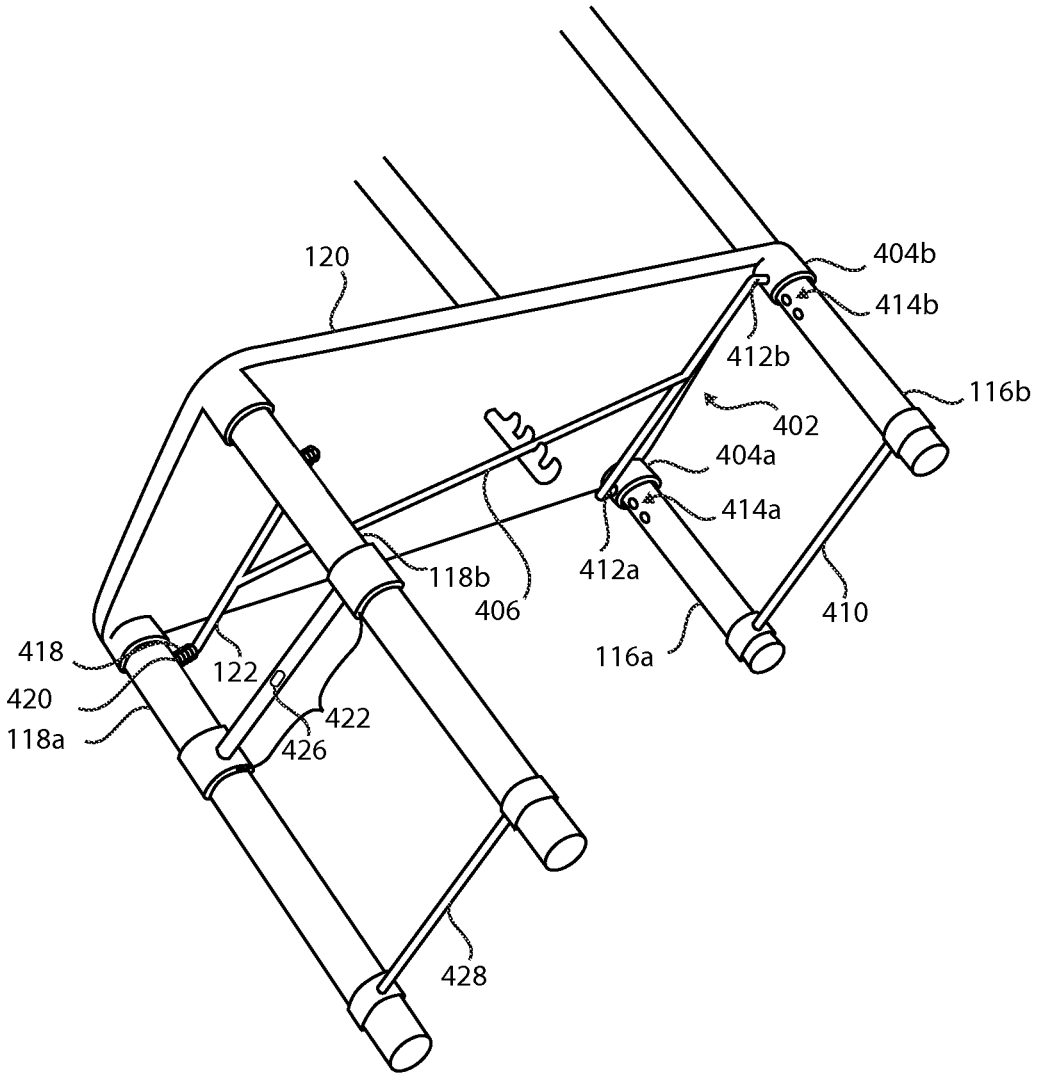
FIG. 4A is an oblique bottom view of the preferred embodiment of FIG. 1A, showing in more detail the front adjustment mechanism.

FIG. 4A is an oblique bottom view of the preferred embodiment of FIG. 1A, showing in more detail the front adjustment mechanism 402. The adjustment mechanism 402 includes a pair of sleeves 404*a* and 404*b* coupled to the knee support platform 120, each sleeve receiving a corresponding front leg 116*a* and 116*b*, respectively, for sliding motion unless the motion is restrained by a pin, for example, the pins 412*a* and 412*b*. Each of the pins 412*a* and 412*b* restrains sliding motion by interlocking with one of a series 414*a* or 414*b* of apertures in its corresponding leg 116*a* or 116*b*. The pins 412*a* and 412*b* are operated together for disengagement from their corresponding apertures by actuation of a spring-loaded bar 122. Moreover, various preferred embodiments can include a front crossbar or crosspiece 410 by which the front legs can be moved together in tandem. The bar 122 may be spring-loaded via one or more springs 418 positioned in, for example, slots or recesses 420 within the rear legs 118*a* and/or 118*b*.

Figure 4B:
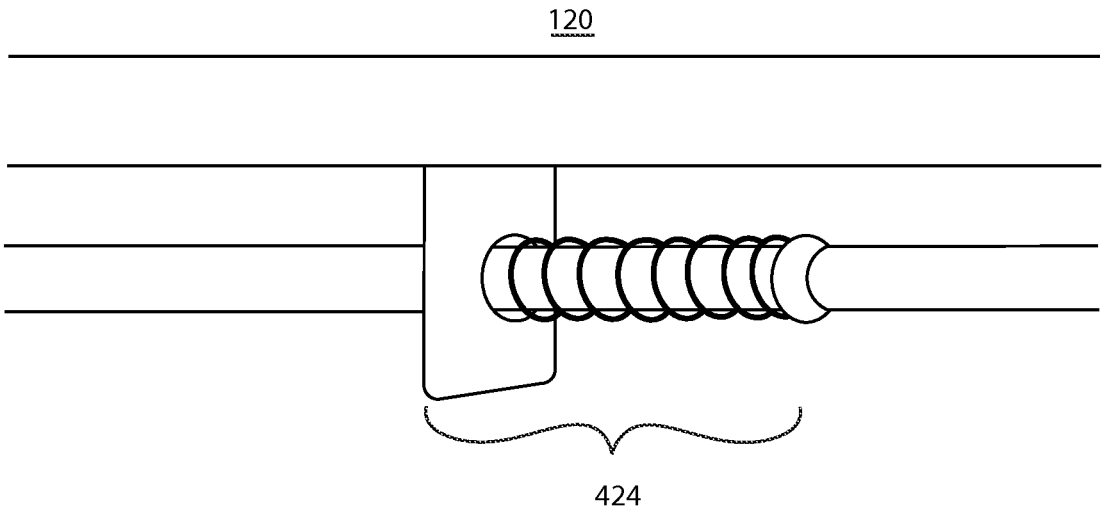
FIG. 4B is an oblique angle view of an embodiment showing a portion of a pull bar spring-loaded via a spring-and-flange arrangement.

FIG. 4B is an oblique angle view of an embodiment showing a portion of a pull bar spring-loaded via a spring-and-flange arrangement. In embodiment of FIG. 4B, the pull bar 122 or linkage 406 (see FIG. 4A) may be spring-loaded via one or more spring-and-flange arrangements 424 through which the sides of the pull bar traverse under the knee support platform 120, guiding the bar and keeping it tensioned. In some other embodiments, the pins 412*a* and 412*b* themselves can be spring-loaded, for example, by springs within the sleeves 404*a* and 404*b*, with the spring-loading of the pins providing corresponding spring-loading of the pull bar 122 via the linkage 406.

Resuming the discussion of FIG. 4A, it also shows a rear adjustment mechanism 422, that is single-hand operable, for example, via a push button 426. In preferred embodiments the rear legs 118*a* and 118*b* are connected by a rear crossbar 428 to enable tandem motion of the rear legs to adjust their length. Details of the rear adjustment mechanism are discussed below in connection with FIG. 7.

Figure 5:
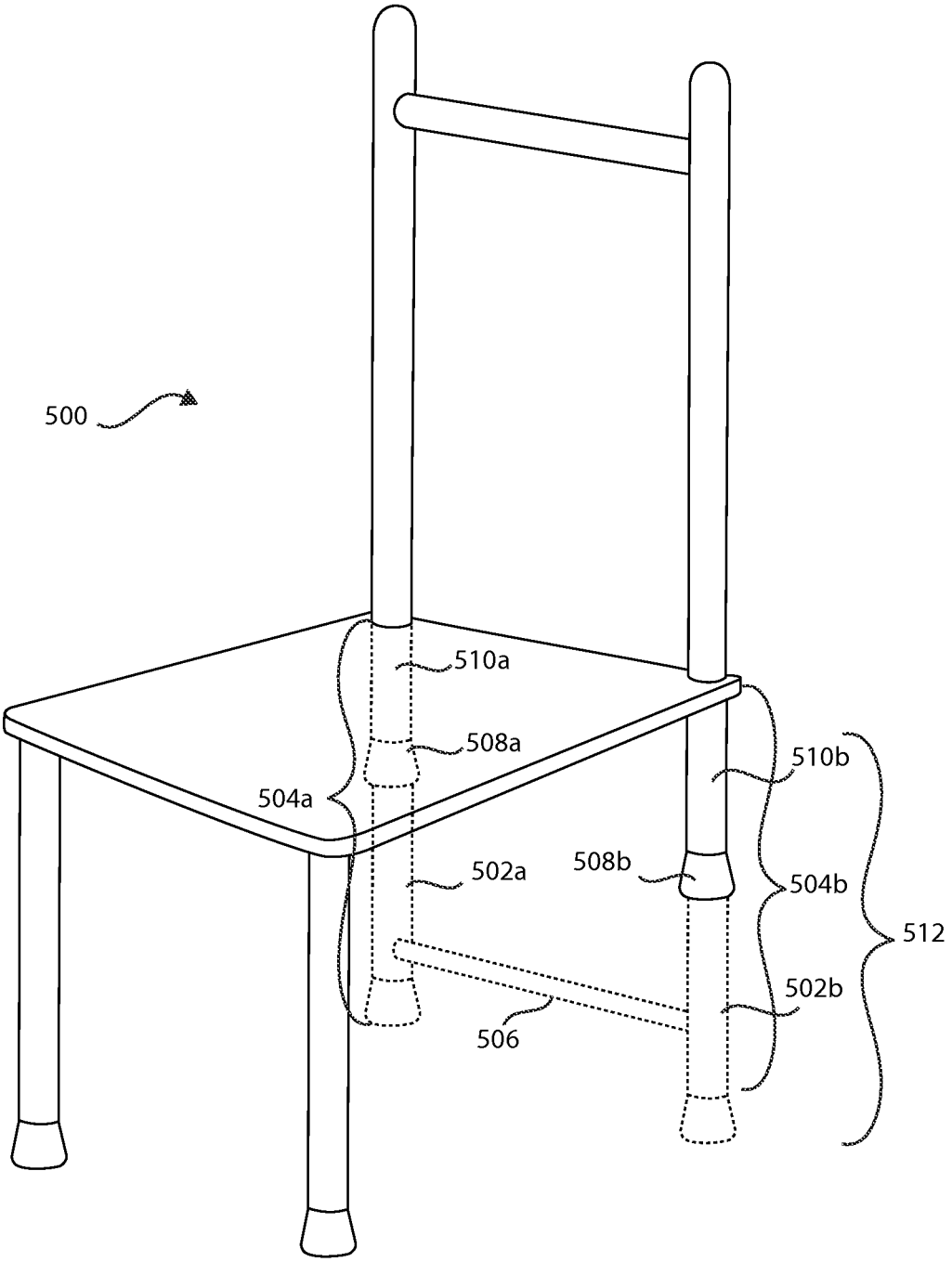
FIG. 5 is an oblique angle view of a preferred embodiment of the present invention, showing manual attachability and detachability of lower portions of the front legs of a adaptable mobility aid device to enable convertibility between use on a level walkway and use on a stairway.

In some preferred embodiments of the present invention, the front legs may be attachable and detachable manually, for example, by using a cross bar to manipulate lower, detachable portions of the legs in tandem. FIG. 5 is an oblique angle view of a preferred embodiment of the present invention, showing attachability and detachability of lower portions 502*a* and 502*b* of the front legs 504*a* and 504*b* of an adaptable mobility aid device 500 to enable convertibility between use on a level walkway 102 (see FIG. 1A) and use on a stairway 202 (see FIG. 2A). In FIG. 5, the lower portions 502*a* and 502*b* of the front legs 504*a* and 504*b* are joined with a cross bar 506 to form an H-shaped structure, so that the lower portions of the front legs may be removed from corresponding sleeves 508*a* and 508*b* in the upper portions 510*a* and 510*b* of the front legs by pulling on the cross bar, thus shortening the front legs for use on stairs. Conversely, the legs can be lengthened by reversing the process to restore the lower portions 502*a* and 502*b* of the front legs 504*a* and 504*b* to nest in the sleeves 508*a* and 508*b*, so that the front legs 504*a* and 504*b* are of a length suitable for use on a level walkway. In this way the cross bar 506, sleeves 508*a* and 508*b*, and nesting lower portions 502*a* and 502*b* together comprise an adjustable coupling 512 that is single-hand operable to adjust the length of the front legs 504*a* and 504*b*.

Figure 6:
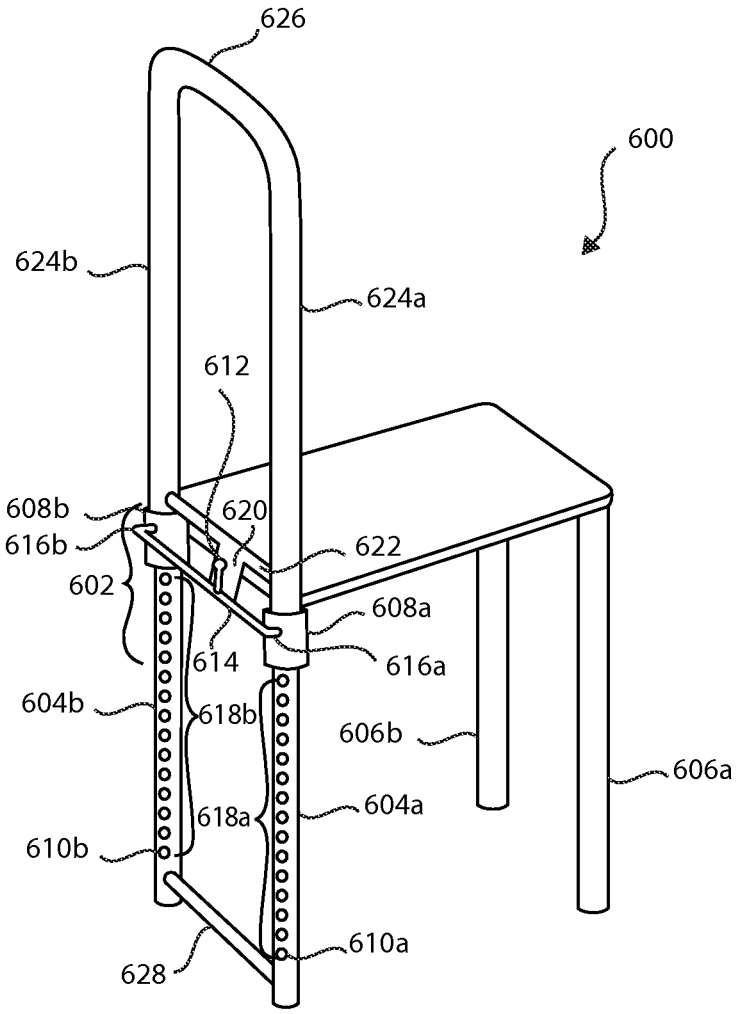
FIG. 6 is an oblique angle view of a preferred embodiment of the present invention, showing an adjustable coupling configured to be single-hand operable, and showing the adaptable mobility aid device as having two front legs, and two rear legs.

FIG. 6 is an oblique angle view of a preferred embodiment of the present invention, showing an adjustable coupling 602 configured to be single-hand operable, and showing the adaptable mobility aid device 600 as having two front legs 604*a* and 604*b*, and two rear legs 606*a* and 606*b*. Each of the front legs 604*a* and 604*b* includes a corresponding nesting portion 610*a* and 610*b*, and a corresponding sleeve portion 608*a* and 608*b* coupled to the nesting portion via the adjustable coupling 602. It is understood that the rear legs 606*a* and 606*b* may in addition have an adjustable coupling configured to be single-hand adjustable, so that the rear legs are length-adjustable as well (see, for example, FIG. 7).

As shown in FIG. 6, the adjustment mechanism includes a spring-loaded tab 612 on a connecting rod 614 that couples with two pins 616*a* and 616*b*. The spring loading is such that each pin 616*a* and 616*b* is normally urged into an aperture on the series 618*a* and 618*b* of apertures, if an aperture is available for engagement with the pin. The tab 612 can be pivoted on for example, a mounting protrusion or tongue 620 attached to a frame that supports the knee support platform 120 (see FIG. 1A), or to a horizontal support bar 622 fastened at each end to upright supports 624*a* and 624*b*. Pressing the tab 612 against the spring loading disengages the pins 616*a* and 616*b* from their respective apertures so that the front legs 604*a* and 604*b* can be shortened or lengthened as desired by sliding the front legs into or out of the upright supports 624*a* and 624*b* for the handle 626. Furthermore, in various embodiments a crossbar 628 connects the front legs 604*a* and 604*b* to enable sliding motion of the front legs in tandem.

In some other embodiments, the adjustment mechanism includes only a single sleeve and corresponding pin, that couple with a central shaft connected to the two front legs 604*a* and 604*b*. The central shaft includes a series of apertures that can mate with the pin to normally restrain motion of the central shaft. Activating the adjustment mechanism via a spring loaded tab enables motion of the central shaft within its sleeve, and thereby enables motion of the legs 604*a* and 604*b* within the upright supports 624*a* and 624*b*.

Figure 7:
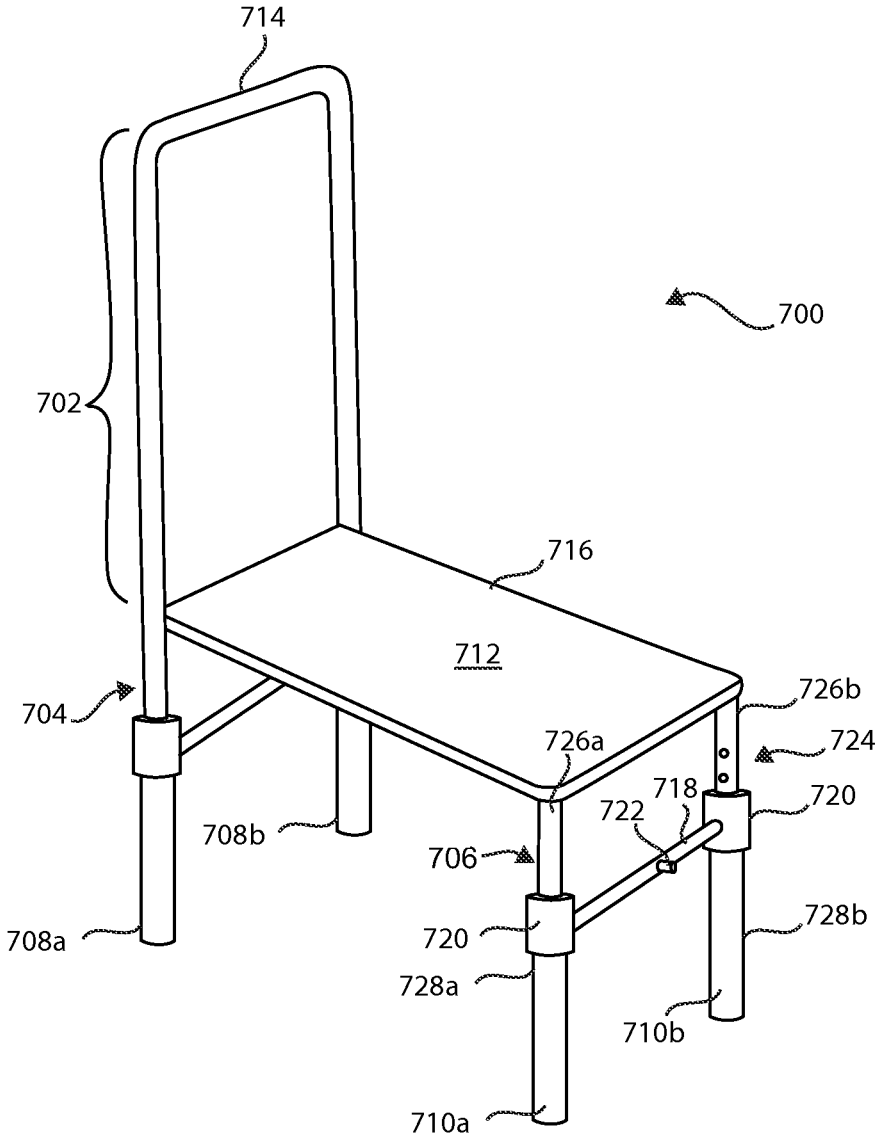
FIG. 7 is an oblique angle view of a preferred embodiment of the present invention, showing an adaptable mobility aid device with a back support frame, and showing a portion of a front adjustment mechanism, and showing a rear adjustment mechanism.

FIG. 7 is an oblique angle view of a preferred embodiment of the present invention, showing an adaptable mobility aid device 700 with a back support frame 702, and showing a portion of a front adjustment mechanism 704, and showing a rear adjustment mechanism 706. Each of the adjustment mechanisms 704 and 706 is configured for single-hand operability and configured to enable length adjustment of two legs alone or in tandem, that is front legs 708*a* and 708*b* alone or in tandem, and rear legs 710*a* and 710*b* alone or in tandem. The front legs 708*a* and 708*b* are capable of adjustment to a first length for use on stairs, and to a second length for use on a level walkway. In the preferred embodiment of FIG. 7, the device 700 also includes a knee support platform 712 coupled to the pair of front legs 708*a* and 708*b*, coupled to the pair of rear legs 710*a* and 710*b*, and coupled to the back support frame 702. In addition, the device 700 includes a handle 714 coupled to the back support frame 702. The knee support platform 712 has a flat upper surface 716, and is also adapted for use as a seat (306, see FIG. 3). As shown, the handle 714 is positioned so that it is on an opposite side of the knee support platform 712 when the device 700 is in use for walking or climbing (see, for example, FIGS. 1A-1E and FIGS. 2B-2E).

The rear adjustment mechanism 706 includes a cylindrical shell 718 that connects two sleeves 720. The shell 718 also contains spring loaded shafts (not shown) coupled to pins disposed within the sleeves 720. A push button 722 protrudes from the center of the shell 718, and is coupled to the spring loaded shafts so that a push of the push button results in withdrawal of each pin from one of a series of apertures 724 in the upper portions 726*a* and 726*b* of the legs. The upper portions 726*a* and 726*b* of the legs 710*a* and 710*b* are received within the sleeves 720 and nest within the lower portions 728*a* and 728*b* of the legs. In this manner the legs 710*a* and 710*b* can be adjusted to various lengths by a push of the push button 722 and motion of the cylindrical shell 718 to slide the lower portions 728*a* and 728*b* of the legs toward or away from the knee support platform 712. The construction and operation of the front adjustment mechanism 704 is similar.

Figure 8:
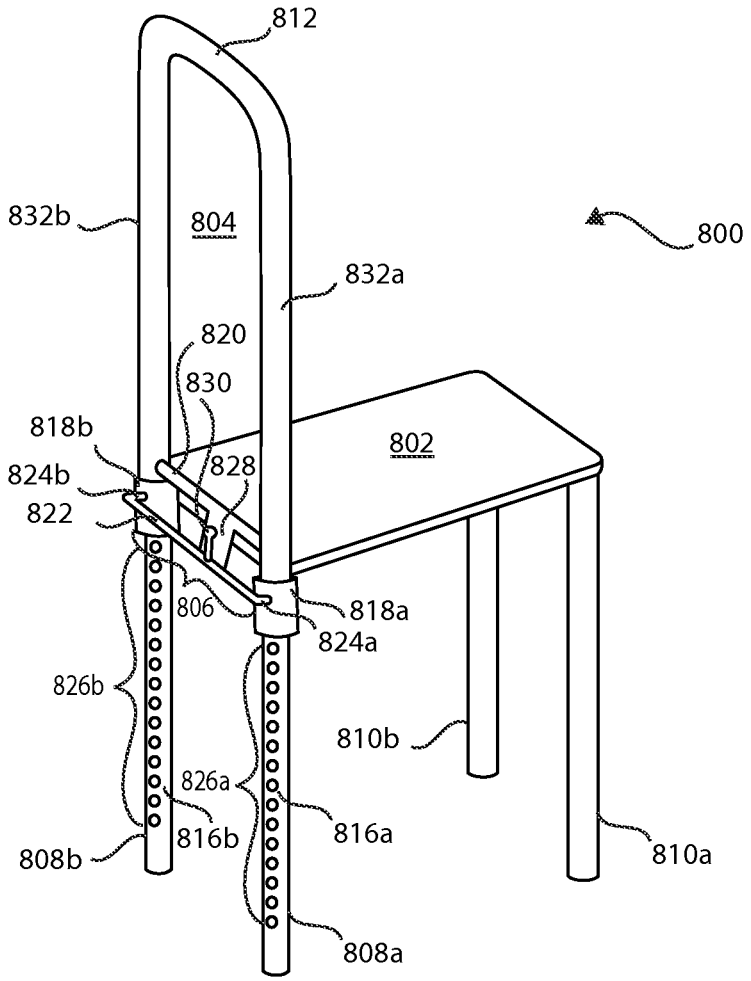
FIG. 8 is an oblique angle view of a preferred embodiment of the present invention, showing an adaptable mobility aid device that includes a seat and a back support surface with the seat also adapted for use as a knee support platform.

FIG. 8 is an oblique angle view of a preferred embodiment of the present invention, showing an adaptable mobility aid device 800 that includes a seat 802 and a back support surface 804. In addition to sitting, the seat 802 is adapted for use as a knee support platform 120 (see, for example, FIGS. 1A-1D). The embodiment of FIG. 8 also includes an adjustment mechanism 806 that can enable length adjustment in tandem of a pair of front legs 808*a* and 808*b* of the device 800, and that is single-hand operable. As with the other embodiments discussed in this disclosure, the front legs 808*a* and 808*b* are configured to engage a walking surface by frictional contact. In addition, the front legs 808*a* and 808*b* can be adjusted to a first length for use on stairs and to a second length for use on a level walkway.

The adaptable mobility aid device 800 also includes a pair of rear legs 810*a* and 810*b* which are configured to engage a walking surface by frictional contact. The rear legs 810*a* and 810*b* can be length-adjustable in tandem via single-hand operability (see, for example, FIG. 7). In addition, the device 800 includes a handle 812 that is coupled to the back support surface 804. As shown, the handle 812 is positioned so that it is on an opposite side of seat 802 when the device 800 is in use for walking or climbing where the seat is used as a knee support platform (see, for example, FIGS. 1A-1D and FIGS. 2B-2E). Also as shown in FIG. 8, the seat 802 is also coupled to the back support surface 804, as well as being coupled to the pair of front legs 808*a* and 808*b*, and to the pair of rear legs 810*a* and 810*b*. Moreover, in the preferred embodiment of FIG. 8, the handle 812 is coupled to the pair of front legs 808*a* and 808*b*, and is coupled to the back support surface 804 through the coupling of the handle to the pair of front legs.

In analogy with the embodiment shown in FIG. 6, the adjustability mechanism 806 is configured to enable length adjustment of the pair of front legs 808*a* and 808*b*, and configured for single-hand operability. Each of the front legs 808*a* and 808*b* includes a corresponding nesting portion 816*a* and 816*b*, and a corresponding sleeve portion 818*a* and 818*b* coupled to the nesting portion via the adjustable coupling 806. It is understood that the rear legs 810*a* and 810*b* may in addition have an adjustable coupling configured to be single-hand adjustable, so that the rear legs are length-adjustable as well (see, for example, FIG. 7).

As shown in FIG. 8, the adjustability mechanism 806 includes a spring-loaded tab 820 on a connecting rod 822 that couples with two pins 824*a* and 824*b*. The spring loading is such that each pin 824*a* and 824*b* is normally urged into an aperture of the series 826*a* and 826*b* of apertures, if an aperture is available for engagement with the pin. The tab 820 can be pivoted on for example, a mounting protrusion or tongue 828 attached to a frame that supports the knee support platform 802, or to a horizontal support bar 830 fastened at each end to upright supports 832*a* and 832*b* that couple the handle 812 to the front legs 808*a* and 808*b*. Pressing the tab 820 against the spring loading disengages the pins 824*a* and 824*b* from their respective apertures so that the front legs 808*a* and 808*b* can be shortened or lengthened as desired by sliding the front legs into or out of the upright supports 832*a* and 832*b* for the handle 812 and back support surface 804. Furthermore, in some embodiments a crossbar 628 (see FIG. 6) connects the front legs 808*a* and 808*b* to enable sliding motion of the front legs in tandem.

Figure 9:
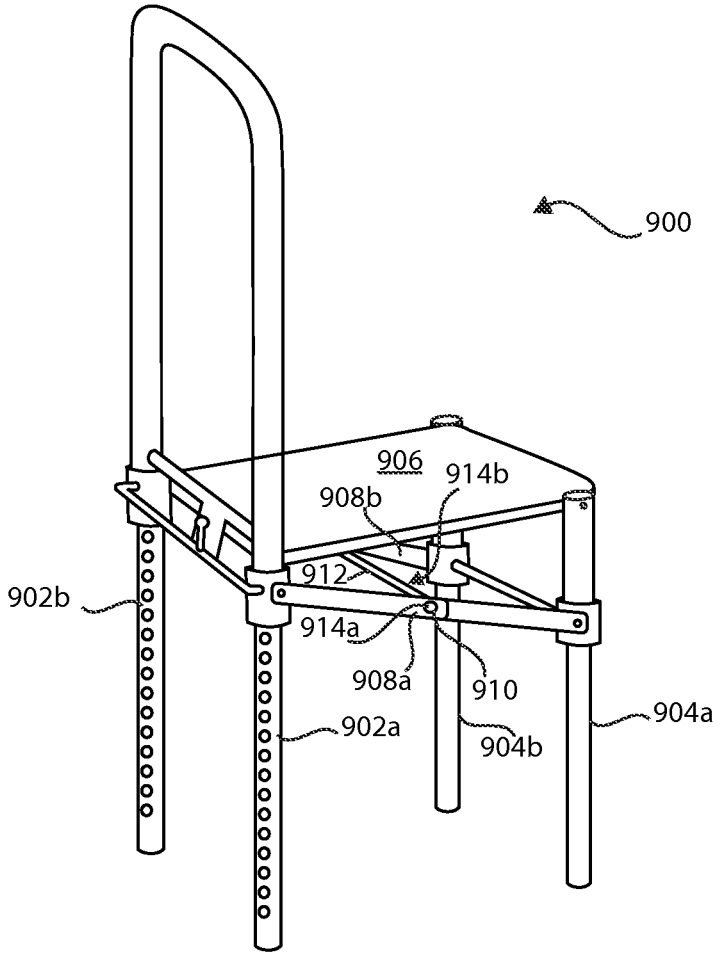
FIG. 9 is an oblique angle view of a preferred embodiment of the present invention, showing the front legs, the rear legs, and the knee support platform in cooperation to enable collapsibility of the device.

FIG. 9 is an oblique angle view of a preferred embodiment of the present invention, showing the walking aid device 900 having a pair of front legs including a left front leg 902*a* and a right front leg 902*b*, a pair of rear legs including a left rear leg 904*a* and a right rear leg 904*b*, and a knee support platform 906 in cooperation to enable collapsibility of the device. For clarity, details of the front and rear adjustment mechanisms have been omitted from FIG. 9. The knee support platform 906 can pivot with respect to the legs 902*a*, 902*b*, 904*a*, and 904*b*, and the device 900 is caused to collapse by bending of a left crossbrace 908*a* and a right crossbrace 908*b* that connect corresponding front and rear legs.

In the embodiment of FIG. 9, the left crossbrace 908*a* is pivotally attached to the left front leg 902*a* and pivotally attached to the left rear leg 904*a*. The left crossbrace 908*a* includes a pivot 910 within a central portion of the left crossbrace to enable bending of the left crossbrace. Similarly, the right crossbrace 908*b* is pivotally attached to the right front leg 902*b* and pivotally attached to the right rear leg 904*b*, the right crossbrace including a pivot (not shown) within a central portion of the right crossbrace to enable bending of the right crossbrace. A rod 912 having a left end 914*a* and a right end 914*b* is connected to the left crossbrace 908*a* at the left end 914*a* to form the pivot 910 of the left crossbrace, and connected to the right crossbrace 908*b* at the right end 914*b* to form the pivot of the right crossbrace. In this manner, a motion of the rod 912, for example, a pull downward on the rod, so as to cause bending of the left crossbrace 908*a* and the right crossbrace 908*b*, enables folding of the device 900 for storage, for example, in a closet or other storage area, or in an automobile or other vehicle. It will be appreciated that in some embodiments a folded adaptable mobility aid device 900 may also function as a cane.

Figure 9A:
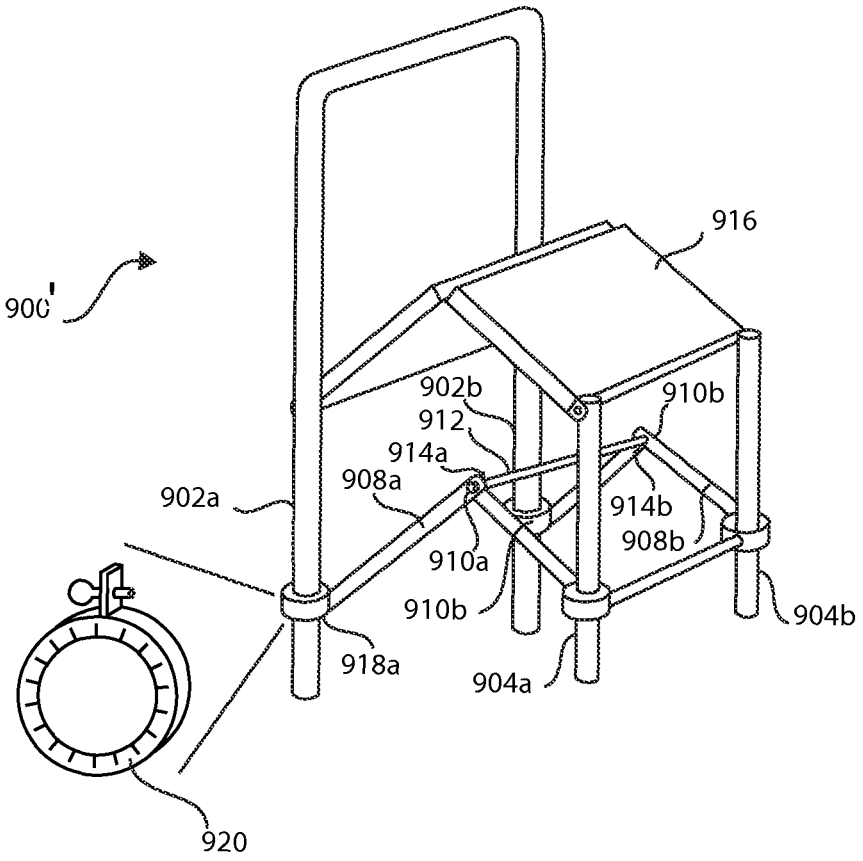
FIG. 9A is an oblique angle view of a preferred embodiment of the present invention, showing an adaptable mobility aid device having a pair of front legs including a left front leg and a right front leg, a pair of rear legs including a left rear leg and a right rear leg, and a knee support platform in cooperation to enable collapsibility of the device.

FIG. 9A is an oblique angle view of a preferred embodiment of the present invention, similar in some respects to the embodiment of FIG. 9, showing a adaptable mobility aid device 900' having a pair of front legs including a left front leg 902*a* and a right front leg 902*b*, a pair of rear legs including a left rear leg 904*a* and a right rear leg 904*b*, and a knee support platform 916 in cooperation to enable collapsibility of the device. For clarity, details of the front and rear adjustment mechanisms have been omitted from FIG. 9A. The knee support platform 916 can pivot with respect to the legs 902*a*, 902*b*, 904*a*, and 904*b*. The knee support platform 916 differs from knee support platform 906 of the embodiment of FIG. 9 in that the knee support platform 916 is foldable, as shown. The device 900' is caused to collapse by bending of a left crossbrace 908*a* and a right crossbrace 908*b* that connect corresponding front and rear legs. By being foldable, the knee support platform 916 can work together with floating clamps 918*a* and 918*b* to enable collapsibility of the adaptable mobility aid device 900'.

In the embodiment of FIG. 9A (as with the embodiment of FIG. 9), the left crossbrace 908*a* is pivotally attached to the left front leg 902*a* and pivotally attached to the left rear leg 904*a*. The left crossbrace 908*a* includes a pivot 910*a* within a central portion of the left crossbrace to enable bending of the left crossbrace. Similarly, the right crossbrace 908*b* is pivotally attached to the right front leg 902*b* and pivotally attached to the right rear leg 904*b*, the right crossbrace including a pivot 910*b* within a central portion of the right crossbrace to enable bending of the right crossbrace. A rod 912 having a left end 914*a* and a right end 914*b* is connected to the left crossbrace 908*a* at the left end 914*a* to form the pivot 910*a* of the left crossbrace, and connected to the right crossbrace 908*b* at the right end 914*b* to form the pivot 910*b* of the right crossbrace.

As mentioned above, the knee support platform 916 is foldable. At the same time, the floating clamps 918*a* and 918*b* can slide along the corresponding front legs 902*a* and 902*b*, respectively, to accommodate the folding of the knee support platform 916. The floating clamps 918*a* and 918*b* may include, for example, a plastic insert 920 that reduces friction between the clamp and the leg, while providing a relatively tight fit between the clamp and the leg. In this manner, a motion of the rod 912, for example, a pull upward on the rod, so as to cause bending of the left crossbrace 908*a* and the right crossbrace 908*b* enables, folding of the device 900' for storage, for example, in a closet or other storage area, or in an automobile or other vehicle. It will be appreciated that in some embodiments a folded adaptable mobility aid device 900' may also function as a cane.

FIG. 10 is an oblique angle view of a preferred embodiment of the present invention, showing an adaptable mobility aid device 1000 having a single adjustable front leg 1002 and a single adjustable rear leg 1004. Each of the front leg 1002 and the rear leg 1004 include a broad support element 1006 and 1008, respectively, at its base to provide lateral stability to the device 1000. The front leg 1002 and the rear leg 1004 can be adjustable via any of the adjustability mechanisms previously described and suitably modified for use with a single leg rather than with legs in tandem. In this embodiment, the knee support platform 1010 is also tilted slightly upwards in the direction from the rear leg towards the front leg. This may be desirable for some users who do not wish to bend their knee at a full 90 degree angle, for example.

Figure 11:
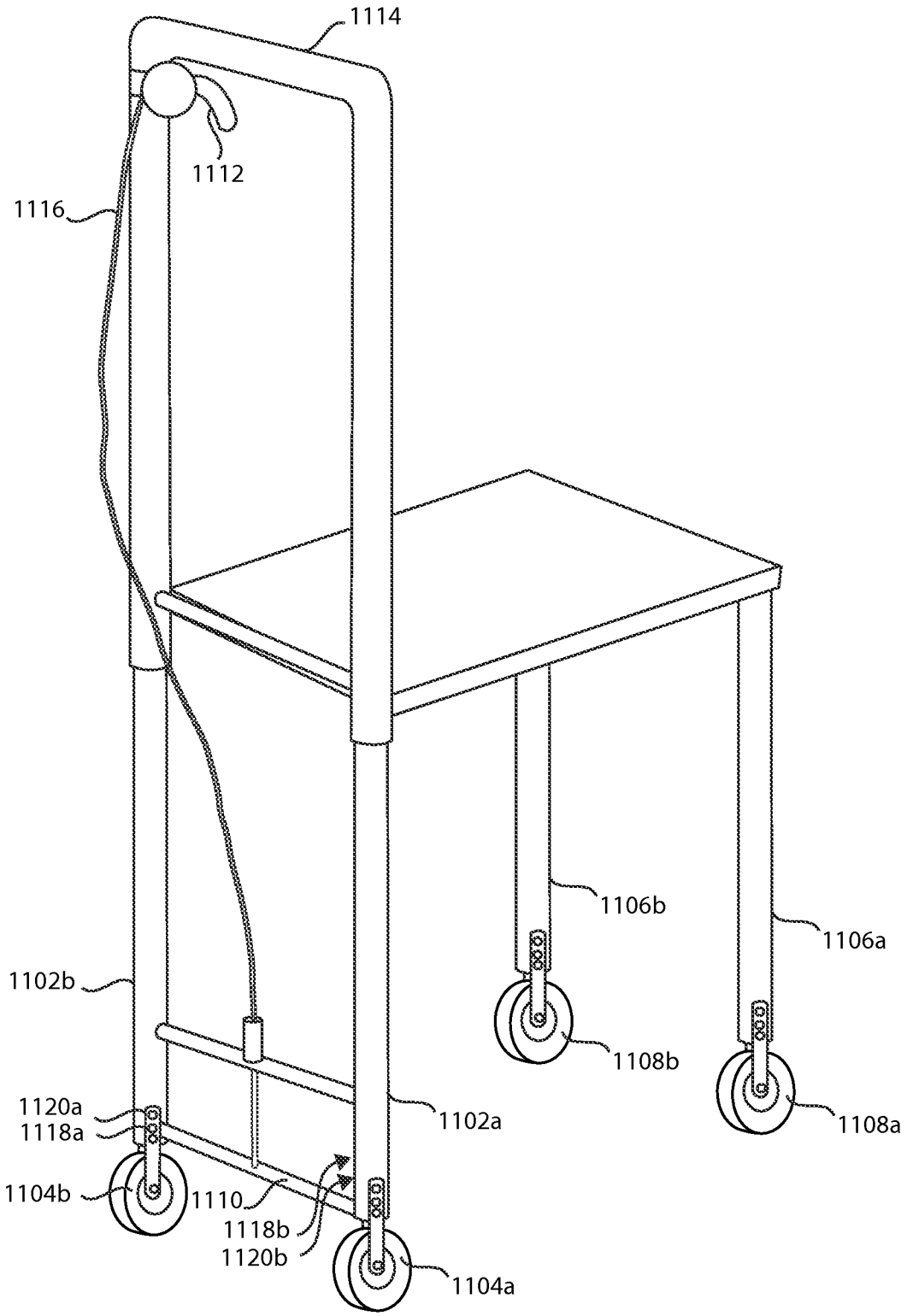
FIG. 11 is an oblique angle view of a preferred embodiment of the present invention, showing an adaptable mobility aid device having front legs with front wheels, and rear legs with rear wheels, and a park bar.

FIG. 11 is an oblique angle view of a preferred embodiment of the present invention, showing an adaptable mobility aid device 1100 having front legs 1102*a* and 1102*b* with front wheels 1104*a* and 1104*b*, and rear legs 1106*a* and 1106*b* with rear wheels 1108*a* and 1108*b*. A park bar 1110 can be operated by a lever 1112 near the handle 1114 to lock the front wheels 1104*a* and 1104*b* to prevent their movement when the device 1100 is used on stairs, or in other situations where rolling of the device is undesirable. The lever 1112 operates a cable 1116 to disengage the park bar 1110 from the front wheels 1104*a* and 1104*b*. The park bar 1110 is normally pressed into contact with the front wheels 1104*a* and 1104*b* by springs 1118*a* and 1118*b* disposed in slots 1120*a* and 1120*b* to resist motion of the front wheels. For clarity, details of the front and rear adjustment mechanisms are omitted from FIG. 11.

Figure 12A:
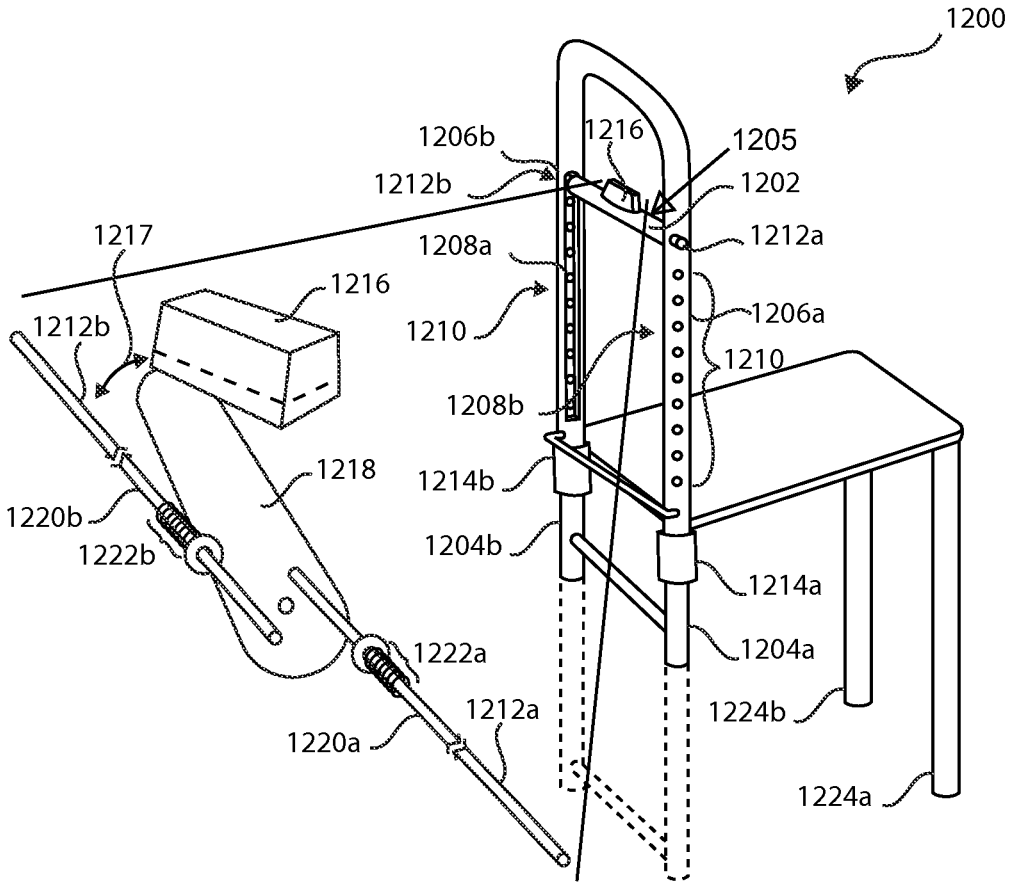
FIG. 12A is an oblique angle view of a preferred embodiment showing an adaptable mobility aid device with front leg adjustability via an adjusting bar connected to the front legs.

FIG. 12A is an oblique angle view of a preferred embodiment showing an adaptable mobility aid device 1200 with front leg adjustability via an adjusting bar 1202 connected to the front legs 1204*a* and 1204*b*, the adjusting bar acting as an adjustment mechanism 1205, as explained below. The front legs 1204*a* and 1204*b* are adapted to slide within support uprights 1206*a* and 1206*b* that include slots 1208*a* and 1208*b* to accommodate the adjusting bar 1202. The support uprights 1206*a* and 1206*b* also include apertures 1210 to receive pins 1212*a* and 1212*b* that can maintain the front legs 1204*a* and 1204*b* at a suitable length for stair use, or for use on a level walkway.

In more detail, the front legs 1204*a* and 1204*b* can slide via sleeves 1214*a* and 1214*b* within the support uprights 1206*a* and 1206*b*. Springs 1213*a* and 1213*b*, or other energy storage devices, for example, energy storage devices having pneumatic or hydraulic arrangements, provide a restoring force to the interior portions 1215*a* and 1215*b* of the front legs 1204*a* and 1204*b*, respectively, that slide within the support uprights 1206*a* and 1206*b*.

When the user on a level walkway arrives at a stairway, the user can place the device 1200 on the stairway so as to straddle both the end of the level walkway and the first step of the stairway. After the user activates the adjustment mechanism 1205, the weight of a user on the knee support platform 120 (see FIG. 1A) can force the front legs 1204*a* and 1204*b* to adjust to the appropriate leg length for stair use. When the user wishes to resume motion on a level walkway, the device 100 can be converted back to flat walkway use by lifting the knee 114 (see FIG. 1A) slightly from the knee support platform 120 and activating the adjustment mechanism 1205. The springs 1213*a* and 1213*b* then can exert force against the interior portions 1215*a* and 1215*b* to extend the front legs 1204*a* and 1204*b*. In this manner the device 1200 enables single hand adjustability of the length of the front legs 1204*a* and 1204*b*.

The adjustment mechanism 1205 includes a push button 1216 on the adjusting bar 1202 that can move 1217 a cam 1218 coupled to spring-loaded rods 1220*a* and 1220*b* that end with the pins 1212*a* and 1212*b*. Motion of the cam can draw the pins 1212*a* and 1212*b* from the apertures 1210 to enable the front legs 1204*a* and 1204*b* to slide for length adjustment. The spring loading of the pins 1212*a* and 1212*b* may be accomplished, for example, by spring and flange arrangements 1222*a* and 1222*b*. It is understood that the rear legs 1224*a* and 1224*b* may be length adjustable as described above in connection with other embodiments.

Figure 12B:
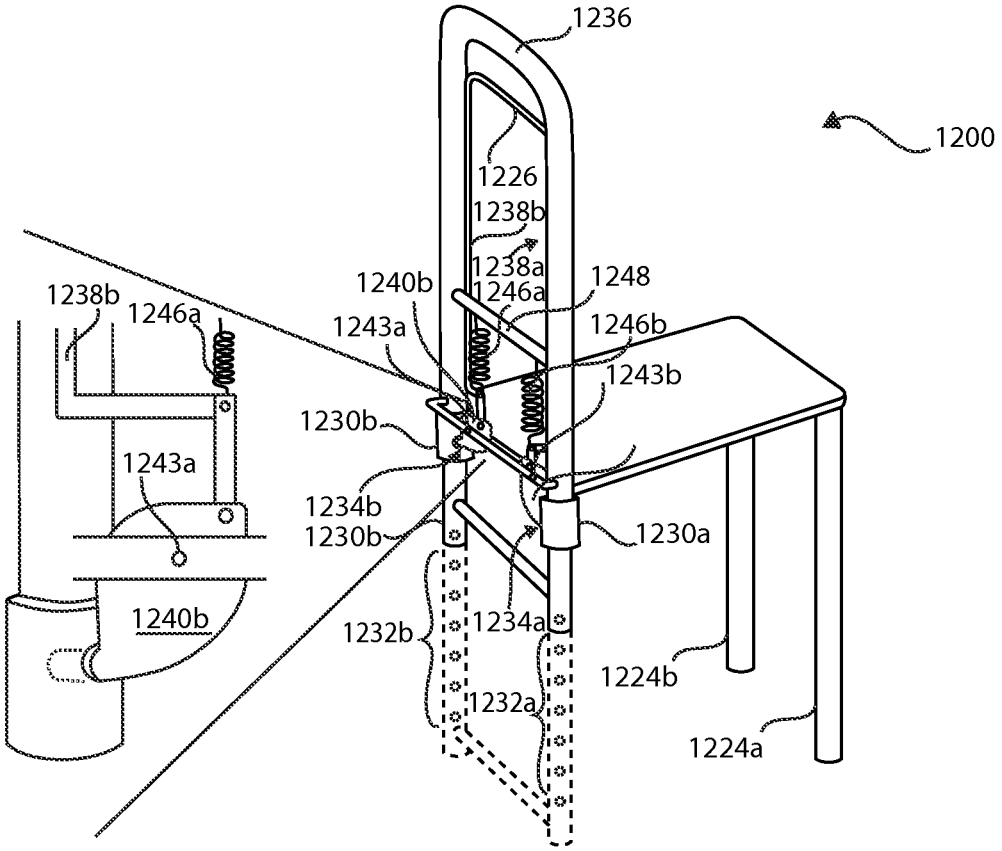
FIG. 12B is an oblique angle view of a preferred embodiment, showing an adaptable mobility aid device having front leg adjustability via an adjusting bar mounted for sliding motion on support uprights.

FIG. 12B is an oblique angle view of a preferred embodiment, similar in some respects to the embodiment of FIG. 12A, showing an adaptable mobility aid device 1200' having front leg adjustability via an adjusting bar 1226 mounted for sliding motion on support uprights 1228*a* and 1228*b*. The front legs 1230*a* and 1230*b* are adapted to slide within the support uprights 1228*a* and 1228*b*, and include apertures, some of which are shown in dashed outline at 1232*a* and 1232*b*, that can mate with pins 1234*a* and 1234*b* operated via the adjusting bar 1226. The apertures 1232*a* and 1232*b* and pins 1234*a* and 1234*b* can maintain the front legs 1230*a* and 1230*b* at a suitable length for stair use, or for use on a level walkway. The adjusting bar 1226 is mounted near a handle 1236 for convenience of use.

As discussed above in connection with FIG. 12A, the front legs 1204*a* and 1204*b* can slide via sleeves 1214*a* and 1214*b* within the support uprights 1206*a* and 1206*b*. Springs 1213*a* and 1213*b*, or other energy storage devices, for example, energy storage devices having pneumatic or hydraulic arrangements, provide a restoring force to the interior portions 1215*a* and 1215*b* of the front legs 1204*a* and 1204*b*, respectively, that slide within the support uprights.

When the user on a level walkway arrives at a stairway, the user can place the device 1200 on the stairway so as to straddle both the end of the level walkway and the first step of the stairway. After the user activates the adjustment mechanism, the weight of a user on the knee support platform can force the front legs to adjust to the appropriate leg length for stair use. When the user wishes to resume motion on a level walkway, the device 100 can be converted back to flat walkway use by lifting the knee 114 slightly from the knee support platform and activating the adjustment mechanism. The springs 1213*a* and 1213*b* then can exert force against the interior portions 1215*a* and 1215*b* to extend the front legs 1204*a* and 1204*b*. In this manner the device 1200 enables single hand adjustability of the length of the front legs.

The adjusting bar 1226 is coupled to the pins 1234*a* and 1234*b* by rods 1238*a* and 1238*b* mounted on the support uprights 1228*a* and 1228*b* and capable of sliding motion along the support uprights. The rods 1238*a* and 1238*b* are pivotally connected to motion transfer plates 1240*a* and 1240*b* on which the pins 1234*a* and 1234*b* are mounted. The motion transfer plates 1240*a* and 1240*b* are mounted on a cross member 1242 at pivots 1243*a* and 1243*b*. An upward motion of the adjusting bar 1226 can thus result in rotation 1244 of the motion transfer plates 1240*a* and 1240*b* to withdraw the pins 1234*a* and 1234*b* from apertures in the front legs 1230*a* and 1230*b* currently mated with the pins, thus enabling the front legs to slide for length adjustability. Springs 1246*a* and 1246*b* coupled to an anchor member 1248 and to the motion transfer plates 1240*a* and 1240*b* provide a restoring force to allow the pins 1234*a* and 1234*b* to once again mate with available apertures on the front legs 1230*a* and 1230*b*. It is understood that the rear legs 1224*a* and 1224*b* may be length adjustable as described above in connection with other embodiments. It will also be appreciated that springs similar to 1213*a* and 1213*b* may be included in an adjustment mechanism for the rear legs 1224*a* and 1224*b*.

Figure 13:
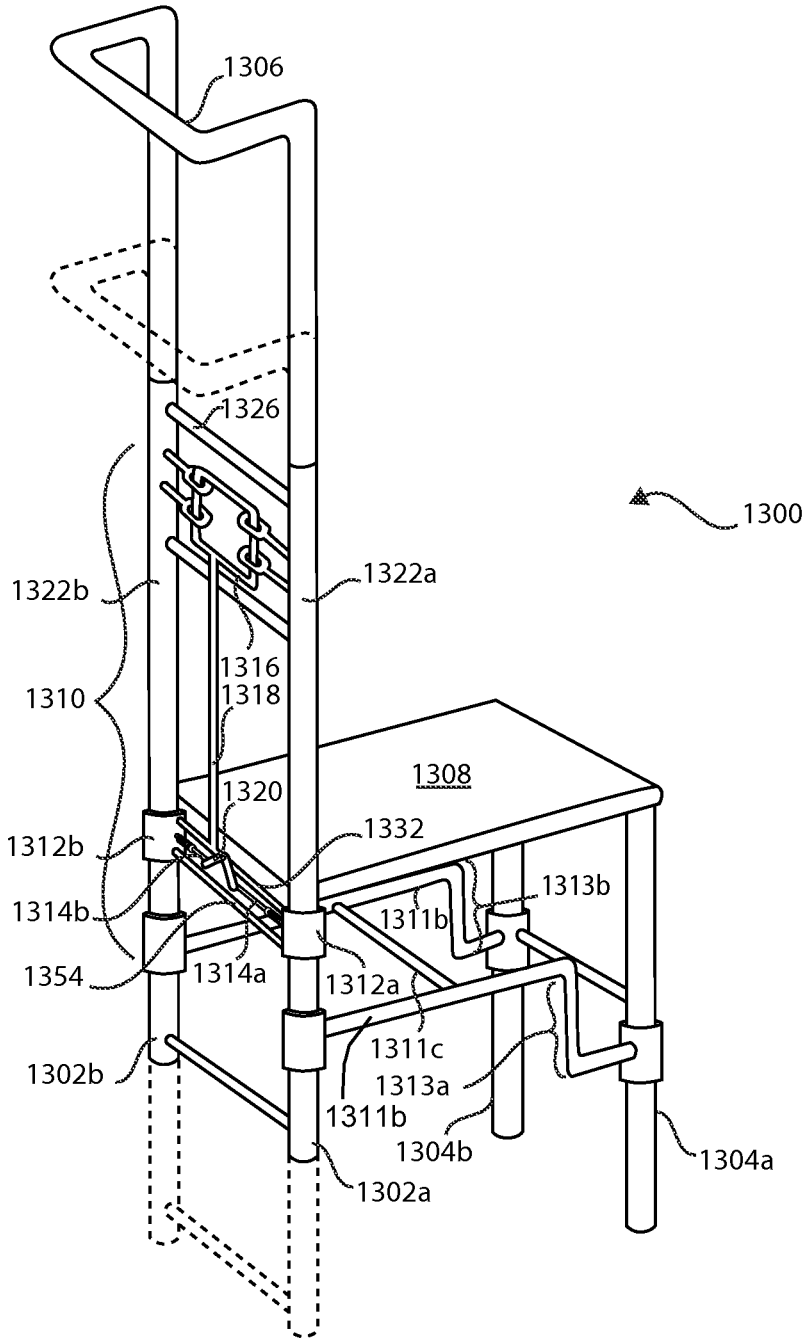
FIG. 13 is an oblique angle view of a preferred embodiment showing front leg adjustability via a release handle coupled by a cable to spring loaded pins.

FIG. 13 is an oblique angle view of an embodiment of the present invention, showing an adaptable mobility aid device 1300 that affords single hand adjustability of the front legs 1302*a* and 1302*b* via a release handle coupled by a cable to spring loaded pins. The device 1300 also includes rear legs 1304*a* and 1304*b*, a handle 1306, a knee support platform 1308, and an adjustment mechanism 1310. The rear legs 1304*a* and 1304*b* can also be adjustable via a rear leg adjustment mechanism, for example, one similar to rear adjustment mechanism 422 (see FIG. 4A) or rear adjustment mechanism 706 (see FIG. 7). The rear legs 1304*a* and 1304*b* are connected with the front legs 1302*a* and 1302*b* via reinforcing members 1311*a* and 1311*b* connected by a cross member 1311*c*. The reinforcing members 1311*a* and 1311*b* are shown with doglegs or offsets 1313*a* and 1313*b* that enable greater adjustability of the rear legs.

The adjustment mechanism 1310 includes adjustable couplings in sleeves 1312*a* and 1312*b*, left and right pin and spring arrangements 1314*a* and 1314*b*, respectively, and a release handle 1316 connected by a cable 1318 to a pin actuator 1320. In various embodiments a rod may be used in place of the cable 1318.

The front legs 1302*a* and 1302*b* are configured to slide within support uprights 1322*a* and 1322*b*. The front legs 1302*a* and 1302*b* are coupled with the handle 1306 so that raising the handle raises the front legs, effectively shortening them. To lengthen the legs 1302*a* and 1302*b*, the handle 1306 can be pushed down. If the adjustment mechanism 1310 is not actuated, the front legs are held in position with respect to the adjustable couplings 1312*a* and 1312*b* by the left and right pin and spring arrangements 1314*a* and 1314*b* that engages apertures in the support uprights 1322*a* and 1322*b* and apertures (not shown) in the front legs 1302*a* and 1302*b*.

Figure 13A:
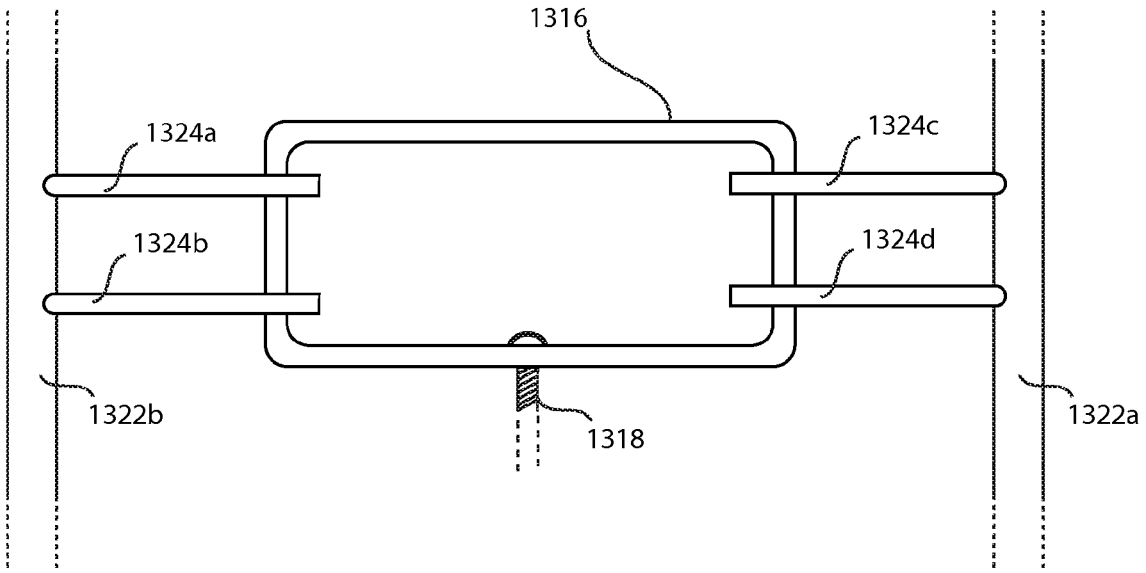
FIG. 13A is a front view showing the release handle of FIG. 13 in more detail.

The adjustment mechanism 1310 is actuated via operation of the release handle 1316. FIG. 13A is a front view showing the release handle 1316 of FIG. 13 in more detail. As shown in FIG. 13A, the release handle 1316 is slidably coupled with the support uprights 1322*a* and 1322*b* by guides 1324*a*-1324*d* coupled to the support uprights. A crossbar, referred to herein as a lower handle 1326, is coupled to the support uprights 1322*a* and 1322*b*. A user 108 (see FIG. 1A) of the device 1300 can hold both the lower handle 1326 and the release handle 1316. By squeezing the release handle 1316 toward the lower handle 1326, the user 108 can draw the release handle upward, thereby drawing the end of the cable 1318 upward.

Figure 13B:
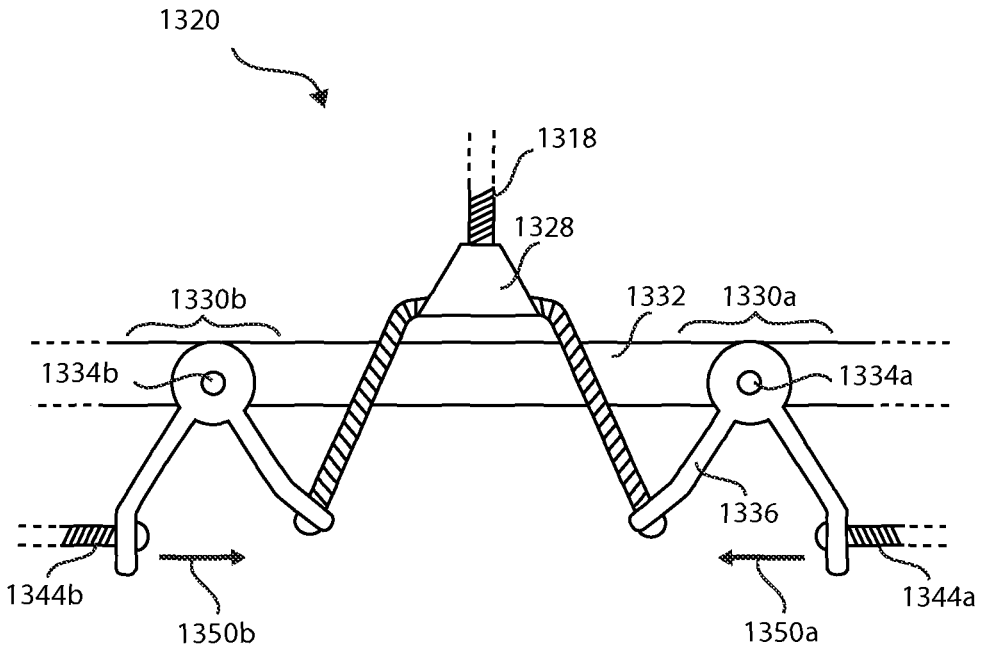
FIG. 13B is a front view showing a pin actuator of FIG. 13 in more detail.

FIG. 13B is a front view showing the pin actuator 1320 of FIG. 13 in more detail. As shown in FIG. 13B, the other end of the cable 1318 is connected to the pin actuator 1320 at a saddle 1328. The pin actuator 1320 includes a first lever 1330*a* and a second lever 1330*b* pivotably mounted to a crosspiece 1332 via pivots 1334*a* and 1334*b*.

The first lever 1344 includes a first inside arm 1336 and a first outside arm 1338. The second lever 1330*b* includes a second inside arm 1340 and a second outside arm 1342. The first outside arm 1338 secures one end of a left cable 1344*a* connected to the left pin and spring arrangement 1314*a*. The second outside arm 1342 secures one end of a right cable 1344*b* connected to the right pin and spring arrangement 1314*b*. The denotations left and right typically refer to the perspective of a user using the device 1300.

One end of a transfer cable 1346 is connected to the first inside arm 1336. The other end of the transfer cable 1346 is connected to the second inside arm 1340. The saddle 1328 holds a middle portion of the transfer cable, and thus enables transfer of force from the cable 1318 to the transfer cable 1346. In alternative embodiments the first and second levers

1330*a* and 1330*b* can be replaced with two pulleys, with a longer transfer cable that engages the two pulleys and also replaces the cables 1344*a* and 1344*b*.

With this configuration, when the user 108 (see FIG. 1A) draws the release handle 1316 upward, the cable 1318, via the transfer cable 1346, draws the inside arms 1340 and 1336 upward, which results in the outside arms 1342 and 1338 drawing the ends of the cables 1344*a* and 1344*b* toward one another and way from the their nearest supports upright 1322*a* and 1322*b*, respectively, as shown by the arrows 1350*a* and 1350*b*. The motions of the cables 1344*a* and 1344*b* are communicated to the pins of the pin and spring arrangements 1314*a* and 1314*b*, discussed next.

Figure 13C:
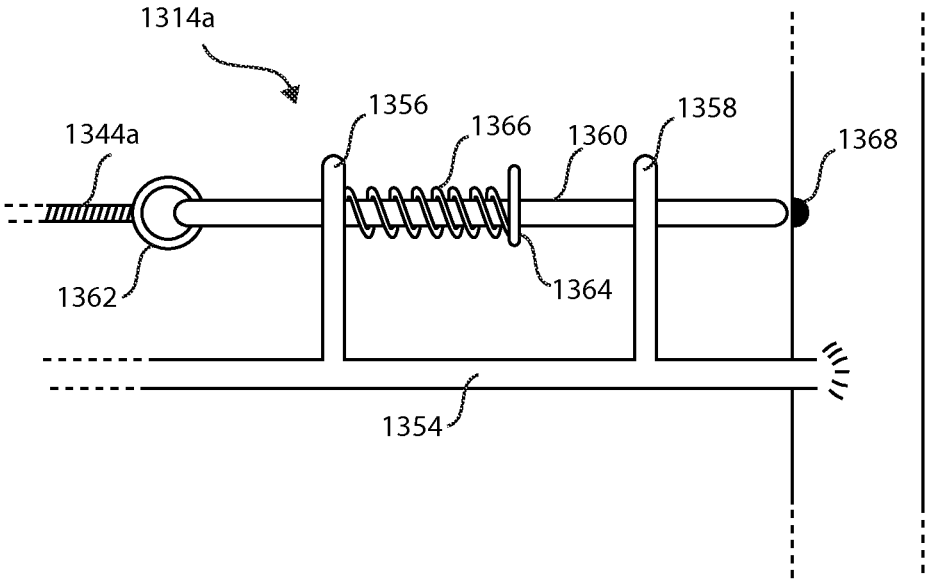
FIG. 13C is a front view showing a pin and spring arrangement of FIG. 13 in more detail.

FIG. 13C is a front view showing the pin and spring arrangement 1314*a* of FIG. 13 in more detail. As shown in FIG. 13C, the left pin and spring arrangement 1314*a* includes a holding bracket 1354 that spans the two support uprights 1322*a* and 1322*b*. The holding bracket includes two vertical members 1356 and 1358 for the left pin and spring arrangement 1314*a*, through which a pin 1360 passes. A ring 1362 at one end of the pin 1360 connects the pin with the other end of the cable 1344*a*. A spring 1366 encircles the pin 1360, and is positioned between the vertical member 1356 and a washer 1364 fixed to the pin. When the cable 1344*a* is drawn away from the support upright 1322*a* a sufficient distance, the pin 1360 is drawn out of an aperture 1368, and the washer 1364 compresses the spring 1366 against the vertical member 1356. Thus, when the pin actuator 1320 is no longer activated, that is, when the user 108 (see FIG. 1A) releases the release handle 1316, the energy stored in the compressed spring 1366 can be released, with the pin 1360 moving back into the aperture 1368. When the pin 1360 moves back into the aperture 1368, the pin can engage one of a series of apertures similar to the series 618*a* (see FIG. 6) but disposed on the leg 1302*a* so as to align with the aperture 1368, and the pin can thereby secure the left leg against sliding within the support upright 1322*a*. The right pin and spring arrangement 1314*b* is configured similarly.

In other embodiments, interior springs 1213*a* and 1213*b* (see FIG. 12A), or other energy storage devices, for example, energy storage devices having pneumatic or hydraulic arrangements, provide a restoring force to interior portions 1215*a* and 1215*b* of the front legs 1302*a* and 1302*b*, respectively, that slide within the support uprights 1322*a* and 1322*b*.

Thus, in these other embodiments, when the user 108 (see FIG. 1A) on a level walkway arrives at a stairway, the user can place the device 1300 on the stairway so as to straddle both the end of the level walkway and the first step of the stairway. After the user activates the adjustment mechanism 1310, the weight of a user on the knee support platform 1308 can force the front legs 1302*a* and 1302*b* to adjust to the appropriate leg length for stair use. When the user 108 wishes to resume motion on a level walkway, the device 1300 can be converted back to flat walkway use by lifting the knee 114 slightly from the knee support platform 1308 and activating the adjustment mechanism 1310. The springs 1213*a* and 1213*b* (see FIG. 12A) then can exert force against the interior portions 1215*a* and 1215*b* of the front legs 1302*a* and 1302*b* to extend the front legs. In this manner the device 1300 enables single hand adjustability of the length of the front legs 1302*a* and 1302*b*.

Figure 14:
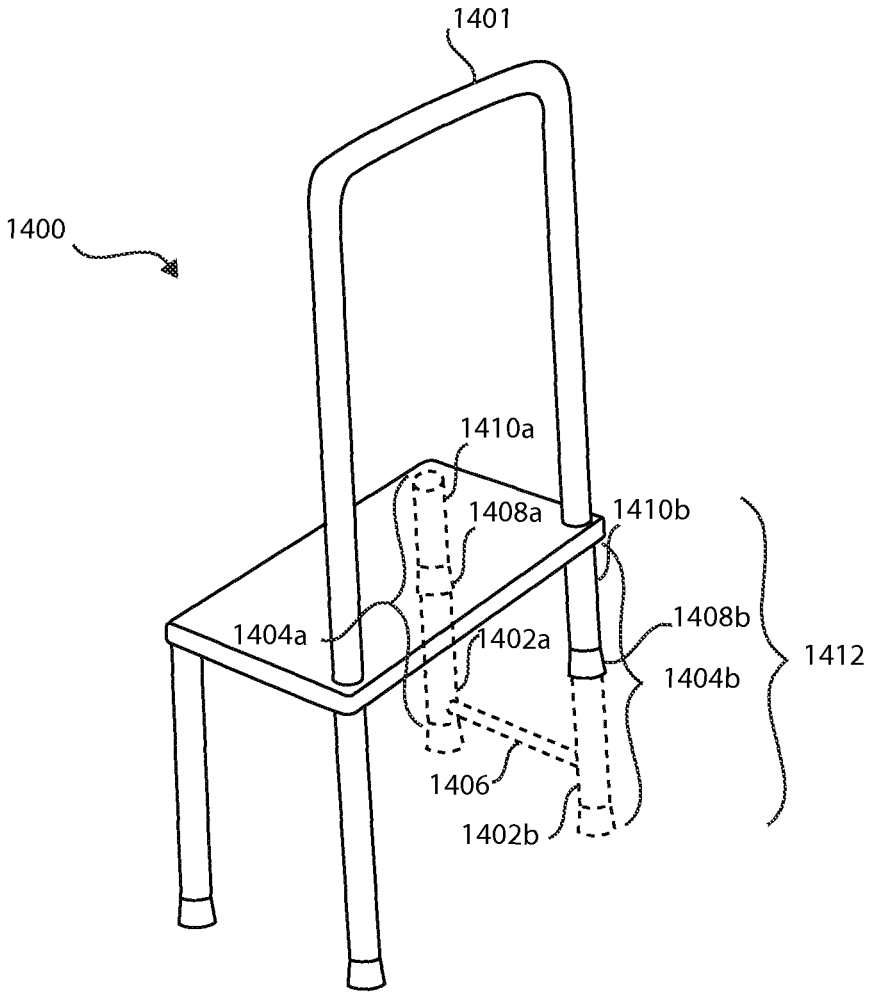
FIG. 14 is an oblique angle view of a preferred embodiment similar to that shown in FIG. 5, but with the handle on the side of the device, rather than on the front.

FIG. 14 is an oblique angle view of a preferred embodiment similar to that shown in FIG. 5, but with the handle 1401 on the side of the device 1400, rather than on the front. As with the embodiment of FIG. 5, the front legs 1404*a* and 1404*b* may be attachable and detachable manually, for example, by using a cross bar to manipulate lower, detachable portions of the legs in tandem. In FIG. 14, the lower portions 1402*a* and 1402*b* of the front legs 1404*a* and 1404*b* are joined with a cross bar 1406 to form an H-shaped structure, so that the lower portions of the front legs may be removed from corresponding sleeves 1408*a* and 1408*b* in the upper portions 1410*a* and 1410*b* of the front legs by pulling on the cross bar, thus shortening the front legs for use on stairs. Conversely, the legs can be lengthened by reversing the process to restore the lower portions 1402*a* and 1402*b* of the front legs 1304*a* and 1404*b* to nest in the sleeves 1408*a* and 1408*b*, so that the front legs 1404*a* and 1404*b* are of a length suitable for use on a level walkway. In this way the cross bar 1406, sleeves 1408*a* and 1408*b*, and nesting lower portions 1402*a* and 1402*b* together comprise an adjustable coupling 1412 that is single-hand operable to adjust the length of the front legs 1404*a* and 1404*b*.

Figure 15:
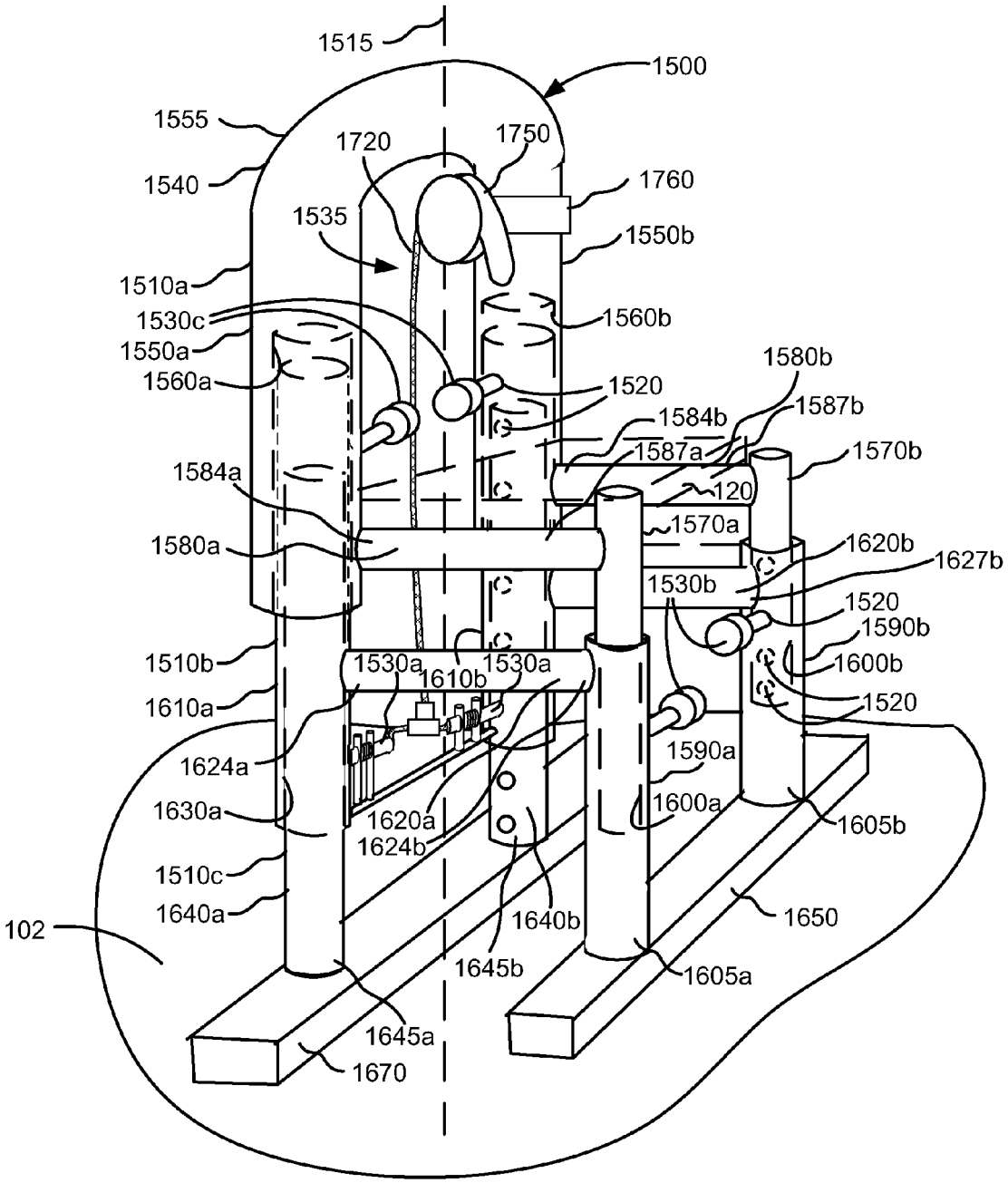
FIG. 15 is an oblique angle view of a preferred embodiment, showing an adaptable mobility aid device with proportions altered for clarity, the adaptable mobility aid device including a plurality of interconnectable segments.
Figure 16:
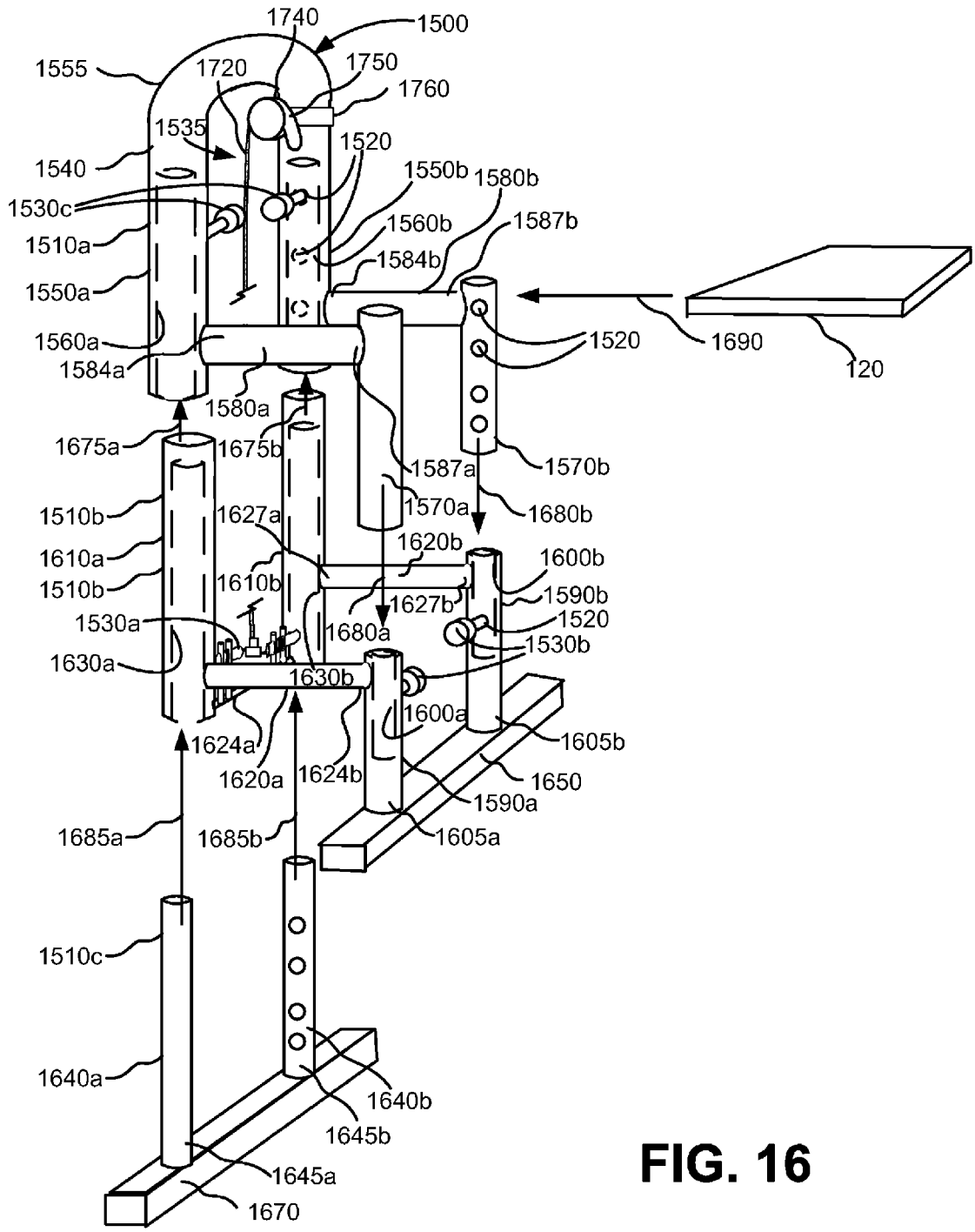
FIG. 16 is an exploded, oblique angle view of the preferred embodiment of FIG. 15 that shows the adaptable mobility aid device with proportions altered for clarity, the adaptable mobility aid device including the plurality of interconnectable segments.

Referring to FIGS. 15 and 16, there is shown a preferred embodiment of a segmented adaptable mobility aid device, generally referred to as 1500, particularly for use on stairway 202 (see FIG. 2A). Segmented adaptable mobility aid device 1500 may also be used on level or inclined walkway 102 (see FIG. 2A), if desired. As shown in FIGS. 15 and 16, segmented adaptable mobility aid device 1500 includes a plurality of vertically aligned, interconnectable segments comprising a first segment 1510*a*, a second segment 1510*b* and a third segment 1510*c*. Segments 1510*a*/1510*b*/1510*c* are stackable end-to-end and alignable generally along a vertical axis 1515 for reasons described hereinbelow. Although three interconnectable segments 1510*a*, 1510*b* and 1510*c* are shown, it should be appreciated that the invention is not limited to three interconnectable segments. More than three interconnectable segments may be provided, if desired, and configured according to the teachings herein. However, at least two interconnectable segments are required, so that segmented adaptable mobility aid device 1500 is height-adjustable for accommodating the height of user 108 and for ascending or descending stairway 202.

Referring again to FIGS. 15 and 16, at least one of the segments 1510*a*/1510*b*/1510*c* has at least one aperture 1520 for reasons described presently. In this regard, a plurality of pins, such as first pins 1530*a*, second pins 1530*b* and third pins 1530*c*, engage respective ones of apertures 1520 for interconnecting segments 1510*a*/1510*b*/1510*c* and for securing segments 1510*a*/1510*b*/1510*c* against movement relative to each other. Pins 1530*a* may be spring-loaded, so that pins 1530*a* can be manipulated by means of a cable and spring arrangement, generally referred to as 1535. Cable and spring arrangement 1535 is described in detail hereinbelow. Pins 1530*b* and 1530*c* are manipulated manually rather than by a cable and spring arrangement. More specifically, pins 1530*b* and 1530*c* are caused to engage selected ones of apertures 1520 in a manner that adjusts the height of first segment 1510*a* to the height of second segment 1510*b*. After pins 1530*a* and pins 1530*b* engage their respective apertures 1520, the pins 1530*a* and 1530*b* are not subsequently readjusted. In other words, pins 1530*a* and 1530*b* are only adjusted once, in the manner described immediately hereinabove. Suitably adjusting the height of first segment 1510*a* with respect to the height of second segment 1510*b*, in turn, adjusts previously mentioned support platform 120 to the height of the knee of user 108, so that the knee of user 108 can be comfortably supported by support platform 120. Knee support platform 120 is configured to be mounted on or coupled to first segment 1510*a* for providing knee support or optionally for providing a seat for user 108. In other words, and as described in more detail hereinbelow, first segment 1510*a* is configured to receive support platform 120. Support platform 120 is shown in phantom in FIG. 15 for clarity in illustrating the invention.

Still referring to FIGS. 15 and 16, first segment 1510*a* includes a handle 1540 sized to be gripped by a hand of user 108, so that user 108 can utilize segmented adaptable mobility aid device 1500 to move himself from one stair step (i.e., tread) to another stair step on the previously mentioned stairway 202 (see FIG. 2A). Also, if desired, user 108 can utilize segmented adaptable mobility aid device 1500 to move himself from one location to another location on the previously mentioned inclined walkway 102 (see FIG. 2A).

Referring yet again to FIGS. 15 and 16, handle 1540 of first segment 1510*a* includes a pair of elongate, parallel handle arms 1550*a* and 1550*b* integrally attached to a generally horizontally-oriented handlebar portion 1555. Handlebar portion 1555 has an inverted U-shape configuration, so that a hand of user 108 can easily grasp handle 1540. Handle arms 1550*a* and 1550*b* have a first chamber 1560*a* and a second chamber 1560*b* extending longitudinally therein, respectively, for reasons provided hereinbelow. First segment 1510*a* also includes a first pair of elongate, parallel legs 1570*a* and 1570*b* disposed generally opposite handle arms 1550*a*/1550*b* for reasons provided hereinbelow. A laterally extending first brace 1580*a* and a laterally extending second brace 1580*b* are coupled to respective ones of handle arms 1550*a* and 1550*b* and respective ones of legs 1570*a* and 1570*b* for providing structural rigidity to first segment 1510*a*, such that handle 1540 and legs 1570*a*/1570*b* are maintained in an upright position as segmented adaptable mobility aid device 1500 is utilized by user 108. More specifically, first brace 1580*a* has a first end 1584*a* thereof coupled to handle arm 1550*a* and a second end 1587*a* thereof coupled to leg 1570*a*. Similarly, second brace 1580*b* has a first end 1584*b* thereof coupled to handle arm 1550*b* and a second end 1587*b* thereof coupled to leg 1570*b*.

As shown in FIGS. 15 and 16, height of segmented adaptable mobility aid device 1500 is adjusted and locked to accommodate the height of user 108. More specifically, second segment 1510*b* includes a second pair of elongate, parallel legs 1590*a* and 1590*b*. As described in more detail momentarily, second pair of legs 1590*a* and 1590*b* is configured to slidably receive respective ones of first pair of legs 1570*a*/1570*b*. In this regard, second pair of legs 1590*a*/1590*b* has a third chamber 1600*a* and a fourth chamber 1600*b* longitudinally extending therein, respectively. Also, first pair of legs 1570*a*/1570*b* is sized to slidably fit within respective ones of third chamber 1600*a* and fourth chamber 1600*b* that are defined by second pair of legs 1590*a*/1590*b*. In addition, second pair of legs 1590*a* and 1590*b* have lower end portions 1605*a* and 1605*b*, respectively, for reasons provided hereinbelow. Previously mentioned apertures 1520 are formed through both second pair of legs 1590*a*/1590*b* of second segment 1510*b* and first pair of legs 1570*a*/1570*b* of first segment 1510*a*, so that, as apertures 1520 are aligned by vertical movement of first segment 1510*a* relative to second segment 1510*b*, pins 1530*b* and 1539*c* can be manually inserted into apertures 1520. Insertion of pins 1530*b* and 1530*c* into their respective apertures 1520 fixes the positions of first segment 1510*a* and second segment 1510*b* relative to each other. Moreover, as described in detail hereinbelow, previously mentioned cable and spring arrangement 1535 is utilized by user 108 to insert pins 1530*a* into apertures 1520 that are formed in support uprights 1610*a*/1610*b* (e.g., see FIG. 16).

With reference again to FIGS. 15 and 16, second segment 1510*b* also comprises a pair of elongate, parallel support uprights 1610*a* and 1610*b* that are coupled to respective ones of second pair of legs 1590*a* and 1590*b*. In this regard, support uprights 1610*a*/1610*b* are coupled to second pair of legs 1590*a*/1590*b* by means of a laterally extending third support brace 1620*a* and a laterally extending fourth support brace 1620*b*. More specifically, third support brace 1620*a* and fourth support brace 1620*b* are coupled to respective ones of support uprights 1610*a* and 1610*b* and also coupled to respective ones of second pair of legs 1590*a* and 1590*b* for providing structural rigidity to second segment 1510*b*, such that support uprights 1610*a*/1610*b* and legs 1590*a*/1590*b* are maintained in an upright position as segmented adaptable mobility aid device 1500 is utilized by user 108. More particularly, third support brace 1620*a* has a first end 1624*a* thereof coupled to support upright 1610*a* and a second end 1624*b* thereof coupled to leg 1590*a*. Similarly, fourth support brace 1620*b* has a first end 1627*a* (see FIG. 16) thereof coupled to support upright 1610*b* and a second end 1627*b* thereof coupled to leg 1590*b*.

Referring again to FIGS. 15 and 16, support upright 1610*a* is sized to be slidably received in first chamber 1560*a* defined by handle arm 1550*a* and support upright 1610*b* is sized to be slidably received in second chamber 1560*b* defined by handle arm 1550*b*. In addition, support upright 1610*a* defines a third chamber 1630*a* therein and support upright 1610*b* defines a fourth chamber 1630*b* (see FIG. 16) therein for reasons provided hereinbelow.

As shown in FIGS. 15 and 16, third segment 1510*c* comprises a third pair of elongate, parallel legs 1640*a* and 1640*b*. Third pair of legs 1640*a* and 1640*b* have lower end portions 1645*a* and 1645*b*, respectively, for reasons provided hereinbelow. Leg 1640*a* is sized to be slidably received in third chamber 1630*a* that is defined by support upright 1610*a*. Leg 1640*b* is sized to be slidably received in fourth chamber 1630*b* that is defined by support upright 1610*b*. In this manner, the sliding engagement of third pair of legs 1640*a*/1640*b* of third segment 1510*c* with respective ones of third chamber 1630*a* and fourth chamber 1630*b* defined by support uprights 1610*a*/1610*b* of second segment 1510*b* allow the elevation of third segment 1510*c* to be slidably and downwardly adjusted relative to second segment 1510*b*, in the manner described in detail hereinbelow.

As shown in FIGS. 15 and 16, a first footer 1650, which may be a horizontally-extending elongate bar, is coupled to previously mentioned lower end portions 1605*a*/1605*b* that belong to respective ones of the pair of second legs 1590*a*/1590*b* provided by second segment 1510*b*. Similarly, a second footer 1670, which may be a horizontally-extending elongate bar, is coupled to previously mentioned lower end portions 1645*a*/1645*b* that belong to respective ones of the pair of third legs 1640*a*/1640*b* provided by third segment 1510*c*. First footer 1650 and second footer 1670 provide frictional contact of segmented adaptable mobility aid device 1500 with inclined surface 102 or the steps of stairway 202.

With reference to FIGS. 15 and 16, assembly of segmented adaptable mobility aid device 1500 will now be described. In this regard, support uprights 1610*a*/1610*b* are inserted in the direction of directional arrows 1675*a*/1675*b* into respective ones of chambers 1560*a*/1560*b* as first pair of legs 1570*a*/1570*b* are simultaneously inserted in the direction of directional arrows 1680*a*/1680*b* into respective ones of chambers 1600*a*/1600*b*. Insertion of support uprights 1610*a*/1610*b* into respective ones of chambers 1560*a*/1560*b* allows first segment 1510*a* to be mounted onto second segment 1510*b*. Similarly, third pair of legs 1640*a*/1640*b* is inserted in the direction of directional arrows 1685*a*/1685*b* into respective ones of chambers 1630*a*/1630*b*. Insertion of third pair of legs 1640*a*/1640*b* into respective ones of chambers 1630*a*/1630*b* allows second segment 1510*b* to be mounted onto third segment 1510*c*. As previously indicated, pins 1530*a*/1530*b*/

1530*c* are manipulated by user 108, so as to engage their respective apertures 1520 in order to interlock segments 1510*a*/1510*b*/1510*c*. Support platform 120 is mounted onto braces 1580*a*/1580*b*, such as in the direction of directional arrow 1690, to provide knee support or optionally to provide a seat for user 108.

Figure 17:
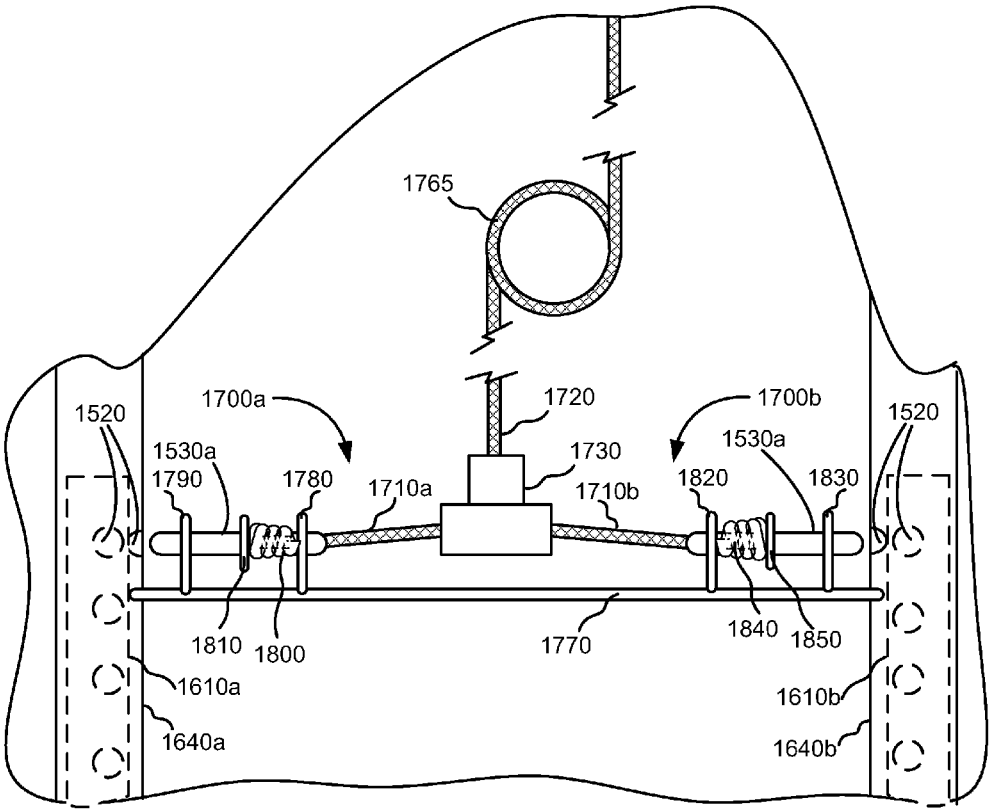
FIG. 17 is a fragmentary view in elevation of an alternative spring arrangement belonging to the preferred embodiment of FIG. 15, this view showing a left pin and spring arrangement and a right pin and spring arrangement.
Figure 18:
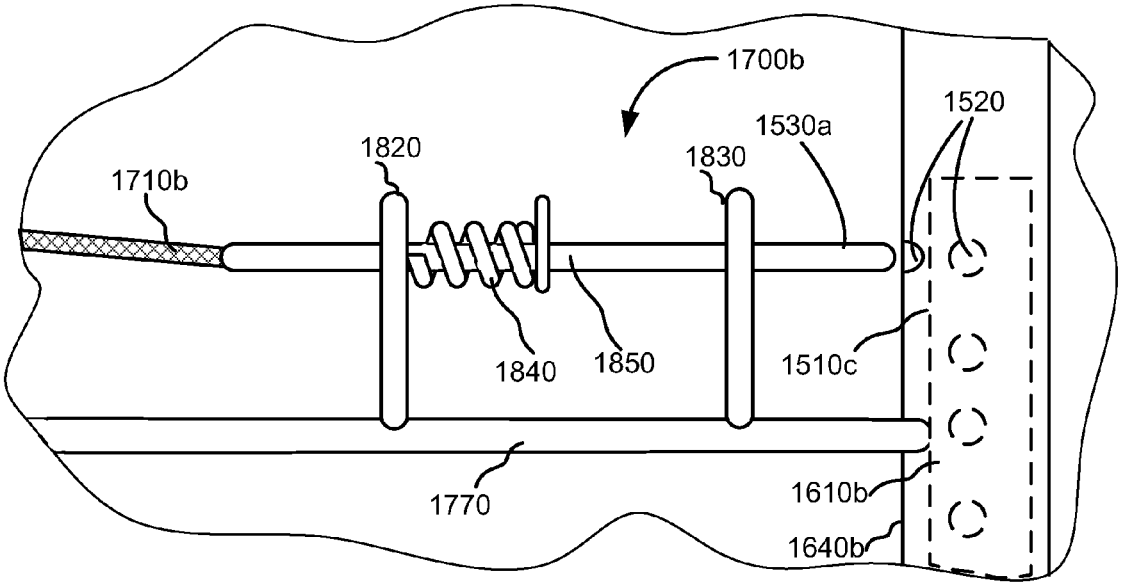
FIG. 18 is a fragmentary view in elevation of the alternative spring arrangement belonging to the preferred embodiment of FIG. 15, this view showing an enlarged detail view of the right pin and spring arrangement.

Referring to FIGS. 15, 16 and 17, previously mentioned cable and spring arrangement 1535 for manipulating first pins 1530*a* will now be described in detail. In this regard, cable and spring arrangement 1535 comprises a left pin and spring arrangement, generally referred to as 1700*a*, and a right pin and spring arrangement, generally referred to as 1700*b*. A left cable 1710*a* is coupled to a leftmost first pin 1530*a* and a right cable 1710*b* is coupled to a rightmost first pin 1530*a*, as shown. Each of cables 1710*a*/1710*b* is joined to a main cable 1720 at a junction 1730. Main cable 1720 is, in turn, coupled to a lever mechanism 1740 having an operable lever 1750. Lever mechanism 1740 is coupled either to leg 1550*a* or leg 1550*b*, such as by a band or strap 1760 extending around leg 1550*a* or leg 1550*b*, as the case may be. User 108 utilizes lever mechanism 1740 to engage pins 1530*a* into their associated apertures 1520 and to disengage pins 1530*a* from the apertures 1520. In this regard, user 108 operates or moves lever 1750, such as downwardly moving lever 1750, to tension main cable 1720. As main cable 1720 is tensioned, left cable 1710*a* and right cable 1710*b* are simultaneously placed in tension because left cable 1710*a* and right cable 1710*b* are joined to main cable 1720 at junction 1730. A portion of main cable 1720 may be in the form of a service loop 1765, if desired, for temporarily allowing slack in main cable 1720 before tensioning of main cable 1720. As described in detail hereinbelow, the configuration and operation of left pin and spring arrangement 1700*a* and the configuration and operation of right pin and spring arrangement 1700*b* allow first pins 1530*a* to engage and disengage apertures 1520 for the reasons provided hereinabove.

Referring again to FIGS. 15, 16 and 17, the configuration and operation of left pin and spring arrangement 1700*a* is described in detail presently. In this regard, left pin and spring arrangement 1700*a* that belongs to cable and spring arrangement 1535 includes an attachment bracket 1770, which spans support uprights 1610*a*/1610*b*. Attachment bracket 1770 includes a first vertical member 1780 and a second vertical member 1790 for left cable and spring arrangement 1700*a*. Pin 1530*a* passes through first vertical member 1780 and second vertical member 1790. Pin 1530*a* is integrally connected to left cable 1710*a* at an end portion of pin 1530*a*. A biasing member, such as a first spring 1800, encircles pin 1530*a*, and is positioned between first vertical member 1780 and a first washer 1810 that is affixed to pin 1530*a*. When lever mechanism 1740 is activated by user 108 moving lever 1750, left cable 1710*a* is drawn away from support upright 1610*a*. As left cable 1710*a* is drawn away from support upright 1610*a* a sufficient distance, pin 1530*a* is drawn out of aperture 1520, and first washer 1810 compresses first spring 1800 against first vertical member 1780. When lever mechanism 1740 is no longer activated, that is, when user 108 releases lever 1750, the energy stored in compressed first spring 1800 is released, with pin 1530*a* moving back into aperture 1520. When pin 1530*a* moves back into aperture 1520, pin 1530*a* secures leg 1640*a* against sliding movement within chamber 1630*a* of support upright 1610*a*.

Referring to FIGS. 15, 16, 17 and 18, the configuration and operation of right pin and spring arrangement 1700*b* is described in detail presently. In this regard, right pin and spring arrangement 1700*b* that belongs to cable and spring arrangement 1535 includes the attachment bracket 1770, which spans support uprights 1610*a*/1610*b*. Attachment bracket 1770 includes a third vertical member 1820 and a fourth vertical member 1830 for right cable and spring arrangement 1700*b*. Pin 1530*a* passes through third vertical member 1820 and fourth vertical member 1830. Pin 1530*a* is integrally connected to right cable 1710*b* at an end portion of pin 1530*a*. A biasing member, such as a second spring 1840, encircles pin 1530*a*, and is positioned between third vertical member 1820 and a second washer 1850 that is affixed to pin 1530*a*. When lever mechanism 1740 is activated by user 108 moving lever 1750, right cable 1710*b* is drawn away from support upright 1610*b*. As right cable 1710*b* is drawn away from support upright 1610*b* a sufficient distance, pin 1530*a* is drawn out of aperture 1520, and second washer 1850 compresses second spring 1840 against third vertical member 1820. When lever mechanism 1740 is no longer activated, that is, when user 108 releases lever 1750, the energy stored in compressed second spring 1840 is released, with pin 1530*a* moving back into aperture 1520. When pin 1530*a* moves back into aperture 1520, pin 1530*a* secures leg 1640*b* against sliding movement within chamber 1630*b* of support upright 1610*b*.

With reference to FIGS. 15, 16, 17 and 18, segmented adaptable mobility aid device 1500 is particularly useful for ascending and descending the steps of stairway 202. In this regard, when user 108 wants to ascend stairway 202, he positions segmented adaptable mobility aid device 1500 in front of the first step of stairway 202. At this point, first pins 1530*a*, second pin 1530*b* and third pins 1530*c* have been previously engaged with their respective apertures 1520, so that segments 1510*a*/1510*b*/1510*c* cannot move relative to each other. Also, at this point, first footer 1650 and second footer 1670 are at the same elevation with respect to each other, with first footer 1650 being positioned above surface 102 and with second footer 1670 being positioned above the first step of stairway 202. User 108 then operates the lever 1750 to release first pins 1530*a* from their respective apertures 1520 to allow first footer 1650 to drop to surface 102 by force of gravity. After first footer 1650 contacts surface 102, user 108 releases the lever 1750 to reengage pins 1530*a* with their associated apertures 1520.

It should be appreciated that the adjustment of segmented adaptable mobility aid device 1500 described hereinabove need be made only once when the steps of stairway 202 are the same height. However, segmented adaptable mobility aid device 1500 will require readjustment in the manner described hereinabove when the steps of stairway 202 have different heights.

Thus, it is appreciated from the teachings hereinabove that segmented adaptable mobility aid device 1500 is height-adjustable via use of second pins 1510*b* and third pins 1510*c* for accommodating users 108 of various heights. Also, segmented adaptable mobility aid device 1500 can be used to ascend and descend stairway 202 via activation of lever 1750, even when one leg of user 108 is immobile.

A segmented adaptable mobility aid device for use on a level walkway or on stairs has been described. The device has length-adjustable front and rear legs, a handle, and a knee support platform coupled to the legs and the handle, so that lengths of the legs can be adjusted in tandem via single-hand operability of an adjustment mechanism. The legs can be adjusted within a range of lengths suitable for walking on a level or inclined walkway, and for ascending and descending stairs. The segmented adaptable mobility aid device includes a knee support platform that, during stairway use, can straddle or span two steps, to better distribute the user's weight during ascent or descent of stairs. The device also includes an adjustment mechanism that can be activated with a single hand to enable length adjustability of the front legs for conversion between use on a level walkway and use on stairs. Embodiments of the invention provide the benefit of increased usability of the device and increased stability of a user during stairway use. Moreover, embodiments of the invention provide the further benefit of single hand operability of the adjustment mechanism.

Other modifications and implementations will occur to those skilled in the art without departing from the spirit and the scope of the invention as claimed. For example, a plurality of lockable wheels (not shown) may be removably coupled to respective ones of first footer 1650 and second footer 1670 for rolling segmented adaptable mobility aid device 1500 along level or inclined surface 102. Accordingly, the above description is not intended to limit the invention except as indicated in the following claims.

What is claimed is:

1. A segmented adaptable mobility aid device that is easily adjusted by a user to accommodate variations in elevation of a surface on which it is deployed comprising:

a first of at least three segments comprising:

a handle extending upwardly in a substantially vertical orientation; and a top portion of a pair of vertically oriented back legs; and a second one of the at least three segments comprising:

a bottom portion of the back pair of legs configured to slideably engaged with the top portion of the back pair of legs of the first segment, the bottom portion having a first footer coupled to the end of each of the pair of back legs; and a middle portion of a front pair of legs being slideably engaged with the bottom of the handle;

a third one of the at least three segments comprising a bottom portion of the front pair of legs that is configured to be slideably engaged with the middle portion of the front pair of legs of the second segment, the bottom portion having a second footer commonly coupled to the end of each of the pair of front legs;

means for establishing a relative position between the second and first footers using the force of gravity, the relative position stably accommodating the relative variations in elevation of the surface, the means for establishing comprising:

a first means for conjointly adjusting and fixing a relative position between the slideably engaged top and bottom portions of each of the back pair of legs;

a second means for conjointly adjusting and fixing a relative position between the slideably engaged handle and the middle portion of each of the front pair of legs; and a third means for conjointly adjusting and fixing a relative position between the slideably engaged middle and bottom portions of the front pair of legs to establish the accommodating relative position, the third means including a lever coupled proximately to the handle, the lever, when actuated, permitting the bottom portions of the front pair of legs to extend or retract as necessary to establish the accommodating relative position using gravity, the relative position being determined when the force of gravity has caused both the front and back feet to be in contact with the surface.

2. The segmented adaptable mobility aid device of claim 1, wherein the means for establishing permits the handle to be raised and lowered without affecting the relative position between the first footer and the second footer.

3. The segmented adaptable mobility aid device of claim 2, wherein:

the first, second and third means for conjointly adjusting and fixing includes a set of pins and a plurality of apertures, each of the at least three segments being slideably adjustable when the segment's set of pins are withdrawn from the apertures and refrained from sliding when the segment's set of pins is engaged in any of the apertures, and the lever of the third means is coupled to the set of pins off the third segment by a cable.

4. The aid apparatus of claim 1 wherein:

the first segment further comprises a platform disposed in a plane substantially perpendicular to the handle, and the front and back pairs of legs; and the platform is configured to be height adjusted, by raising and lowering the first segment relative to the second and third segments, to facilitate support of the user at the knee in lieu of the user's foot.

5. A segmented adaptable mobility aid device comprising:

a first of at least three segments comprising:

a handle extending upwardly in a substantially vertical orientation; and a top portion of a pair of vertically oriented back legs;

a second one of the at least three segments comprising:

a bottom portion of the back pair of legs configured to slideably engage with the top portion of the back pair of legs of the first segment, the bottom portion having a first footer coupled to the end of each of the back pair of legs; and a middle portion of a front pair of legs being slideably engaged with the bottom of the handle;

a third one of the at least three segments is slideably engaged with the second segment comprising a bottom portion of the front pair of legs that is configured to be slideably engaged with the middle portion of the front pair of legs of the second segment, the bottom portion having a second footer commonly coupled to the end of each of the front pair of legs;

a first pin and aperture adjustment mechanism for conjointly adjusting and fixing a relative position between the slideably engaged top and bottom portions of each of the back pair of legs;

a second pin and aperture adjustment mechanism for conjointly adjusting and fixing a relative position between the slideably engaged handle and the middle portion of each of the front pair of legs; and a third pin and aperture adjustment mechanism for conjointly adjusting and fixing a relative position between the slideably engaged middle and bottom portions of the front pair of legs to establish a relative position between the second and first footers that stably accommodates a surface, wherein the first and second pin and aperture adjustment mechanisms adjust the height of the handle to accommodate a user independent of the accommodating relative position between the second and first footers, and wherein the third pin and aperture adjustment mechanism is configured to allow the user to permit the bottom portions of the front pair of legs to extend or retract as necessary to establish the accommodating relative position using gravity, the third pin and aperture adjustment mechanism further being configured to fix the bottom portions of the front pair of legs once the accommodating relative position is established.

6. The segmented adaptable mobility aid device of claim 5, wherein the third pin and aperture adjustment mechanism includes a cable coupled between a set of pins and a lever mechanism, the each of the set of pins configured to be retractably received by a set of apertures disposed in each of the pair of front legs, and the lever mechanism is configured to retract each of the set of pins from the apertures when actuated to permit the bottom portion of the front pair of legs to slide until both the second and first footers are stably resting on the surface to establish the accommodating position, the lever mechanism being further configured to fix the front pair of legs at the accommodating relative position when the lever mechanism is released by allowing each of the set of pins to engage with apertures accessible at the accommodating relative position.

7. The aid apparatus of claim 5 wherein:

the first segment further comprises a platform disposed in a plane substantially perpendicular to the handle, and the front and back pairs of legs; and the platform is configured to be height adjusted, by raising and lowering the first segment relative to the second and third segments, to facilitate support of the user at the knee in lieu of the user's foot.

8. A segmented mobility aid apparatus operable to accommodate level and non-level surfaces comprising:

a first segment forming:

a handle; and a top portion of a back pair of legs;

a second segment forming:

a bottom portion of the back pair of legs configured to slideably cooperate with the top portion, the bottom portion of the pair terminating with a first footer for contacting a surface upon which said apparatus is to be deployed; and a middle portion of a front pair of legs configured to slideably cooperate with the handle;

a third segment forming a bottom portion of the front pair of legs, the bottom portion of the pair co-terminating to form a second footer for contacting the surface upon which said aid device is to be deployed, the bottom portion configured to be slideably engaged with the middle portion of the front legs;

first and second pin and aperture adjustment mechanisms for conjointly adjusting and fixing the first segment with respect to the second segment; and a third pin and aperture adjustment mechanism for conjointly adjusting and fixing the third segment with respect to the second segment, whereby:

raising and lowering the first segment with respect to the second segment raises and lowers the handle without affecting a relative position between the first footer and second-footer; and raising and lowering the third segment with respect to the second segment retracts or extends respectively, the front pair of legs using gravity to establish a relative position between the second and first footers to stably accommodate for unevenness in the surface.

9. The aid apparatus of claim 8 wherein:

the first segment further comprises a platform disposed in a plane substantially perpendicular to the handle, and the front and back pairs of legs; and the platform is configured to be height adjusted, by raising and lowering the first segment relative to the second and third segments, to facilitate support of the user at the knee in lieu of the user's foot.

10. The aid apparatus of claim 9 wherein the platform is configured to be height adjusted, by raising and lowering the first segment relative to the second and third segments, to support the user in a sitting position.

11. The aid apparatus of claim 9 wherein the top portion of the back pair of legs formed by the first segment includes a first pair of tubular members that are configured to be slideably received by the bottom portions of each of the back pair of legs formed by the second segment, the platform being supported by the first segment at, and substantially perpendicular to, the top of the pair of tubular members of the top portion.

12. The aid apparatus of claim 11 wherein the middle portion of the front legs formed by the second segment comprises a pair of tubular members, and the handle of the first segment is formed of a pair of tubular members that are configured to slideably receive the tubular members off the middle portion of the front legs formed by the second segment.

13. The aid apparatus of claim 12 wherein:

the first pin and aperture adjustment mechanism includes a plurality of apertures in at least one of the pair of tubular members of the top portion formed by the first segment, alignable with a plurality of apertures in the tubular members of the bottom portion of at least one of the back pair of legs; and at least one pin that can be actuated to engage and disengage from at least one pair of the aligned apertures to fix the relative position between the pair of tubular members of the top portion and the pair of tubular members of the bottom portion of at least one of the back pair of legs when engaged.

14. The aid apparatus of claim 12 wherein:

the second pin and aperture adjustment mechanism comprises:

a plurality of apertures in at least one of the pair of tubular members formed by the handle, alignable with a plurality of apertures in the middle portion of at least one of the front pair of legs; and at least one pin that can be actuated to engage and disengage from at least one pair of the aligned apertures.

15. The aid apparatus of claim 12 wherein:

the third pin and aperture adjustment mechanism comprises:

a plurality of apertures in at least one of the pair of tubular members of the bottom portion of the front legs, alignable with a plurality of apertures in the tubular members of the middle portion of at least one of the front pair of legs; and at least one pin that can be actuated to engage and disengage from at least one pair of the aligned apertures.

16. The aid apparatus of claim 8 wherein the handle is configured to be height adjusted, by raising and lowering the first segment relative to the second and third segments, to a position that facilitates lifting and placing of said aid apparatus on the surface by a user.

17. The aid apparatus of claim 8 wherein the lower portion of the front legs formed by the third segment comprises a pair of tubular members and are configured to be slideably received by the tubular members of the middle portion of the back legs formed by the second segment.

* * * * *